US011084606B2

(12) United States Patent
Boulais

(10) Patent No.: US 11,084,606 B2
(45) Date of Patent: Aug. 10, 2021

(54) METHOD FOR MANUFACTURING A DEVICE FOR DISPENSING A PRODUCT

(71) Applicant: GB DEVELOPPEMENT, Vernon (FR)

(72) Inventor: Guillaume Boulais, Levallois Perret (FR)

(73) Assignee: GB DEVELOPPEMENT, Vernon (FR)

( * ) Notice: Subject to any disclaimer, the term of this patent is extended or adjusted under 35 U.S.C. 154(b) by 53 days.

(21) Appl. No.: 16/480,698

(22) PCT Filed: Jan. 25, 2018

(86) PCT No.: PCT/EP2018/051898
§ 371 (c)(1),
(2) Date: Jul. 25, 2019

(87) PCT Pub. No.: WO2018/138230
PCT Pub. Date: Aug. 2, 2018

(65) Prior Publication Data

US 2019/0389606 A1 Dec. 26, 2019

(30) Foreign Application Priority Data

Jan. 25, 2017 (FR) ..... 1750598
Jan. 8, 2018 (FR) ..... 1800015

(51) Int. Cl.
*B65B 3/17* (2006.01)
*B05B 11/00* (2006.01)

(52) U.S. Cl.
CPC ..... *B65B 3/17* (2013.01); *B05B 11/0097* (2013.01); *B05B 11/00412* (2018.08);
(Continued)

(58) Field of Classification Search
CPC ..... B65B 3/17; B05B 11/00412; B05B 11/00416; B05B 11/0097; B05B 11/3032; B05B 11/3047; B05B 11/3061
See application file for complete search history.

(56) References Cited

U.S. PATENT DOCUMENTS 5,144,788 A 9/1992 Varlet
5,237,797 A 8/1993 Varlet
(Continued)

FOREIGN PATENT DOCUMENTS

EP 0349396 A1 1/1990
EP 0509179 A1 10/1992
(Continued)

OTHER PUBLICATIONS

International Search Report for corresponding Application No. PCT/EP2018/051898, dated Mar. 26, 2018.
(Continued)

*Primary Examiner* — Vishal Pancholi
(74) *Attorney, Agent, or Firm* — Renner, Otto, Boisselle & Sklar, LLP

(57) ABSTRACT

A method for manufacturing a device for dispensing a product, including a supply of a device having a reservoir, the reservoir being connected to a deformable chamber and being provided with a filling opening, the inside of the deformable chamber being delimited at least in part by a movable wall whose displacement causes a variation of the volume of the deformable chamber; an evacuation step in which a depression is created in the deformable chamber with respect to a reference pressure; a filling step in which the reservoir is filled with product, so that in a so called "intermediate" state of the device, the reservoir is filled with product while the inside of the deformable chamber is at an intermediate pressure lower than the reference pressure; and a closing step in which the filling opening is sealed.

21 Claims, 13 Drawing Sheets

(52) U.S. Cl.
CPC .... *B05B 11/00416* (2018.08); *B05B 11/3032* (2013.01); *B05B 11/3047* (2013.01); *B05B 11/3061* (2013.01)

(56) References Cited

U.S. PATENT DOCUMENTS

| | | | |
|---|---|---|---|
| 2001/0040175 | A1 | 11/2001 | Bailly |
| 2017/0021375 | A1 | 1/2017 | Boulais |

FOREIGN PATENT DOCUMENTS

| | | | |
|---|---|---|---|
| EP | 0928635 | A1 | 7/1999 |
| FR | 3005459 | A1 | 11/2014 |
| WO | 2015/155318 | A1 | 10/2015 |

OTHER PUBLICATIONS

Written Opinion for corresponding Application No. PCT/EP2018/051898, dated Mar. 26, 2018.

METHOD FOR MANUFACTURING A DEVICE FOR DISPENSING A PRODUCT

TECHNICAL FIELD

The present invention relates to a method for manufacturing a device for dispensing a product.

The field of the invention is more particularly that of the dispensation of products such as liquids, gels or creams, for example for the pharmaceutical or cosmetic or agri-food industry.

STATE OF THE ART

Devices are known for dispensing products such as, for example, that described in patent FR 3,005,459 A1. Such a device comprises:

- a deformable chamber,
- a reservoir,
- a dispensing valve for the product outlet from the chamber towards the outside of the device,
- a feed valve for the passage of the product from the reservoir to the chamber.

This device, although it is good, can still be improved because it still poses some technical problems.

A first problem is that of priming, that is to say when the chamber is filled with air when the device is new, and a user is pressing on the chamber so as to pump the product from the reservoir trying to fill the chamber.

This problem is particularly real:

- if the feed valve is flexible especially for a very viscous product to be dispensed, and/or
- if the dispensing valve is very rigid. Indeed, the dispensing valve is a privileged door for the entry of bacteria and oxygen into the reservoir. The more the dispensing valve is tight and therefore rigid, the more difficult the device is to prime, that is to say that the gas initially present in the chamber has difficulties to exit through the dispensing valve and the gas initially contained in the chamber will go rather to the reservoir through the feed valve.

Thus for priming, by pressing the chamber, air can pass through the feed valve rather than through the dispensing valve. It is then difficult to raise the product from the reservoir into the chamber.

The object of the present invention is to provide a method of manufacturing a product dispensing device to solve this problem.

DISCLOSURE OF THE INVENTION

This object is achieved with a method of manufacturing a device for dispensing a product, comprising:

- a evacuation step in which a depression is created in a deformable chamber with respect to a reference pressure,
- a filling step in which a reservoir is filled with product,
- a supply of a device comprising the reservoir, said reservoir being connected to the deformable chamber and being provided with a filling opening, the inside of the deformable chamber being delimited at least in part by a movable wall whose displacement causes a variation of the volume of the deformable chamber and:
  - being separated from the reservoir at least by a feed valve, and/or
  - being separated from an outlet of the device at least by a dispensing valve, then the steps of evacuation, filling and supply being implemented so that, in a so-called "intermediate" state of the device, the reservoir is filled with product while the inside of the deformable chamber is at an intermediate pressure lower than the reference pressure,
- a closing step in which the filling opening is sealed or closed.

According to different embodiments:

- the method according to the invention may comprise the evacuation step and the filling step, then an assembly of the deformable chamber and the reservoir so as to form the device and implement the step of supplying the device; the closing step is preferably performed during assembly of the deformable chamber and the reservoir, or
- the method according to the invention may be a method of manufacturing a product dispensing device, comprising:
  - a supply of a device comprising a reservoir, said reservoir being connected to a deformable chamber and being provided with a filling opening, the inside of the deformable chamber being delimited at least in part by a movable wall whose displacement causes a variation of the volume of the deformable chamber, the device comprising an outlet, then, whatever the order of the following steps:

- an evacuation step in which a depression is created in the deformable chamber with respect to a reference pressure and a filling step in which the reservoir is filled with product, so that, in a so-called "intermediate" state of the device, the reservoir is filled with product while the inside of the deformable chamber is at an intermediate pressure lower than the reference pressure,
- a closing step in which the filling opening is sealed or closed.

The inside of the deformable chamber may:

- be separated from the reservoir at least by a feed valve, and/or
- be separated from the outlet of the device at least by a dispensing valve, then The method according to the invention may further comprise, after the closing step, a priming step during which product is fed from the reservoir to the inside of the deformable chamber.

The priming step may be implemented:

- by exerting a force on the reservoir from outside the reservoir, preferably by mechanical means, and/or
- by subjecting the dispensing valve and/or the feed valve to vibrations, and/or
- by directly opening the dispensing valve and/or the feed valve by a mechanical action, for example by pressing on it.

The priming step may include increasing the pressure around the reservoir to the reference pressure.

The priming step may start while the inside of the deformable chamber is at a priming pressure lower than the reference pressure.

The outlet may be plugged during the priming step

During the evacuation step:

- the volume of the chamber may be varied (i.e. preferably moving the movable wall of the chamber) so as to increase the volume of the chamber and/or to reduce the volume of the chamber, and/or
- the dispensing valve and/or the feed valve may be subjected to vibrations, and/or the dispensing valve and/or the feed valve may be opened directly by mechanical action, for example by pressing on it.

The evacuation step may create the depression in the reservoir, around the reservoir, in the deformable chamber, the deformable chamber to the outlet of the device, and/or the deformable chamber to the reservoir.

The outlet may not be plugged during the evacuation step.

Reservoir walls may be maintained apart during the evacuation step and/or during the filling step. Maintaining apart the walls of the reservoir during evacuation and/or maintaining apart the walls of the reservoir during the filling step may comprise:

maintaining the space between the walls of the reservoir by a filling nozzle inserted into the reservoir through the filling opening and through which the product is discharged during the filling step, and/or maintaining the space between the walls of the reservoir by at least two spacers so that the reservoir is located between the at least two spacers.

In the intermediate state, the reservoir may be filled with product while, around the reservoir, from the deformable chamber to the outlet of the device, and/or from the deformable chamber to the reservoir, the pressure may be at the intermediate pressure and/or less than the reference pressure.

The outlet may be plugged during the filling step.

The closing step may be implemented while the device is in its intermediate state.

The outlet may be plugged during the closing step.

The evacuation step may precede the filling step.

The steps of evacuation, filling and closure may be performed within the same evacuation enclosure.

The steps of:

filling on the one hand, and closing on the other hand may be performed in two separate enclosures. In this case, the filling step may precede the evacuation step.

The leakage rate through the movable wall may be zero and/or the leakage rate through the dispensing valve may be zero.

According to another aspect of the invention, there is provided a system for manufacturing a device for dispensing a product, comprising:

evacuation means arranged to create a depression in a deformable chamber relative to a reference pressure, optionally, filling means arranged to fill a reservoir with product, means for providing a device comprising the reservoir (said supply means comprising, for example, means for assembling the deformable chamber and the reservoir and/or means for conveying the device), said reservoir being connected to the deformable chamber and being provided with a filling opening, the inside of the deformable chamber being delimited at least in part by a movable wall whose displacement causes a variation of the volume of the deformable chamber and:

being separated from the reservoir at least by a feed valve, and/or being separated from an outlet of the device at least by a dispensing valve, then the means of evacuation, (optionally filling) and supply being arranged so that in a so-called "intermediate" state of the device the reservoir is filled with product while the inside of the deformable chamber is at an intermediate pressure lower than the reference pressure, closing means arranged to seal or close the filling opening.

According to different embodiments:

the supply means may comprise assembly means arranged for an assembly (for example after a depression created by the evacuation means and a filling by the filling means) of the deformable chamber and the reservoir; the closure means may comprise the assembly means and may be arranged to seal or close the filling opening during assembly of the deformable chamber and the reservoir by the assembly means, or the supply means may be arranged to provide a device comprising the deformable chamber already assembled to the reservoir, before this device may be submitted (in any order) to the evacuation means, the filling means and the closure means.

The inside of the deformable chamber may:

be separated from the reservoir at least by a feed valve, and/or be separated from the outlet of the device at least by a dispensing valve, then The system according to the invention may comprise priming means arranged to bring product from the reservoir to the inside of the deformable chamber.

The priming means may be arranged to bring this product:

by exerting a force on the reservoir from outside the reservoir, preferably by mechanical means, and/or by subjecting the dispensing valve and/or the feed valve to vibrations, and/or by directly opening the dispensing valve and/or the feed valve by a mechanical action, for example by pressing on it.

The priming means may be arranged to bring this product by increasing the pressure around the reservoir to the reference pressure.

The priming means may be arranged to start priming while the inside of the deformable chamber is at a priming pressure lower than the reference pressure.

The priming means may be arranged to implement priming (i.e. bring this product) while the outlet is plugged.

The evacuation means may be arranged to create depression while:

varying the volume of the chamber (i.e. preferably moving the movable wall of the chamber) so as to increase the volume of the chamber and/or to reduce the volume of the chamber, and/or subjecting the dispensing valve and/or the feed valve to vibrations, and/or directly opening the dispensing valve and/or the feed valve by a mechanical action, for example by pressing on it.

The evacuation means may be arranged to create the depression in the reservoir, around the reservoir, in the deformable chamber, the deformable chamber to the outlet of the device, and/or the deformable chamber to the reservoir.

The evacuation means may be arranged so that the outlet is not plugged during the creation of the depression by the evacuation means.

The system according to the invention may comprise means for keeping apart the walls of the reservoir during the creation of the depression by the evacuation means and/or during filling by the filling means, for example:

by holding the walls of the reservoir apart from each other by means of a filling nozzle inserted in the reservoir through the filling opening and through which the product is discharged during the filling step, and/or by keeping the walls of the reservoir apart from each other by at least two spacers so that the reservoir is located between the at least two spacers.

In the intermediate state, the reservoir may be filled with product wherein around the reservoir, from the deformable chamber to the outlet of the device, and/or from the deformable chamber to the reservoir, the pressure may be at the intermediate pressure and or less than the reference pressure.

The filling means may be arranged so that the outlet is plugged during filling by the filling means.

The closure means may be arranged to seal or close the filling opening while the device is in its intermediate state.

The closure means may be arranged to seal or close the filling opening while the outlet is plugged.

The evacuation means and the filling means may be arranged so that the creation of depression by the evacuation means precedes the filling by the filling means.

The means of evacuation, filling and closure may be grouped within one evacuation enclosure.

Means of:

filling on the one hand and closing on the other hand may be located in two separate enclosures. In this case, the filling means and the closure means may be arranged so that the filling by the filling means precedes the creation of depression by the evacuation means.

DESCRIPTION OF THE FIGURES AND EMBODIMENTS

Other advantages and particularities of the invention will appear on reading the detailed description of implementations and non-limiting embodiments, and the following appended drawings:

FIG. 1 is a profile sectional view illustrating an initial step of a first embodiment of the method according to the invention for manufacturing a device 1, FIG. 2 is a profile sectional view illustrating a evacuation step of the first embodiment of the method according to the invention, FIG. 3 is a profile sectional view illustrating a filling step of the first embodiment of the method according to the invention, FIG. 4 is a profile sectional view illustrating a closing step of the first embodiment of the method according to the invention, FIG. 5 is a profile sectional view illustrating a priming step of the first embodiment of the method according to the invention, FIG. 6 is a profile sectional view of a detail of the device 1 being manufactured in a variant of the first embodiment of the method according to the invention, FIG. 7 is a perspective view of the device 1 in a variant of the first embodiment of the method according to the invention, FIG. 8 is a profile sectional view illustrating a evacuation step of a second embodiment of the method according to the invention, FIG. 9 is a profile sectional view illustrating a closing step of the second embodiment of the method according to the invention, FIG. 10 is a profile sectional view illustrating a priming step of the second embodiment of the method according to the invention, FIG. 11 is a perspective view of a system or installation for implementing a method according to the invention, FIG. 12 is a profile sectional view illustrating different steps of a third embodiment of the method according to the invention;

FIGS. 13 to 16 are complete (FIGS. 13 and 14) or partial (FIGS. 15 and 16) profile sectional views of the device 1 during manufacturing illustrating various steps of a fourth embodiment of the method according to FIGS. invention, and FIGS. 17 to 19 are profile sectional views illustrating a variant of each of the previous embodiments of the method according to the invention.

As these embodiments are in no way limitative, it is possible in particular to consider variants of the invention comprising only a selection of characteristics described or illustrated below in isolation from the other characteristics described or illustrated (even if this selection is isolated within a sentence comprising these other characteristics), if this selection of characteristics is sufficient to confer a technical advantage or to differentiate the invention with respect to the state of the art; This selection comprises at least one preferably functional characteristic without structural details, and/or with only a part of the structural details if this part alone is sufficient to confer a technical advantage or to differentiate the invention with respect to the state of the art.

Firstly, with reference to FIGS. 1 to 7, a first embodiment of the method according to the invention for manufacturing a product dispensing device 16 will be described.

The various technical means described for implementing this method constitute the manufacturing system 10 according to the invention.

The initial step of this method illustrated in FIG. 1 is a step of supplying a device 1 comprising a reservoir 3 and a head 2.

The head 2 comprises a rigid frame (for example polypropylene (PP)), on which is fixed a wall 13 movable and/or deformable (for example polypropylene (PP) with a thickness much thinner than the frame) more flexible than the framework.

The head 2 comprises a deformable chamber 45.

The reservoir 3 is formed by a flexible bag, typically a multilayer polyethylene terephthalate (PET)/aluminum/cast polypropylene (PP) film, the PET layer being towards the outside of the reservoir 3.

The reservoir 3 is provided with:

an orifice 7 communicating with the deformable chamber 45 (via a feed conduit and a feed valve 4) and a filling opening 8.

During this initial step of supply, the interior of the chamber 45 is at a reference pressure.

The filling opening 8 is a direct communication between the inside of the reservoir 3 and the outside of the device 1.

The inside of the deformable chamber 45 is delimited at least in part by the wall 13, a displacement of which causes a variation of the volume of the deformable chamber 45.

During this initial step, the device 1 is "empty".

During this initial step, the reservoir 3 does not include the product 16, and is preferably filled with only gas, preferably air and/or a neutral gas such as nitrogen.

During this initial step, the device 1 does not include the product 16, and is preferably filled with only gas, preferably air and/or a neutral gas such as nitrogen.

During this initial step, the device 1 is in an initial state called "unsealed" because the filling opening 8 exists and is not yet sealed.

The chamber 45 is separated from the reservoir 3 at least by the feed valve 4.

The feed valve 4 is flexible, typically thermoplastic elastomer (TPE) or a thermoplastic polyurethane elastomer of 80 Shore A.

The chamber 45 is arranged so that a decrease in the volume of the chamber 45 (for example by pressing on the wall 13) closes the feed valve 4, at least when the chamber 45 is filled (preferably completely) with the product 16 (which is not yet the case in this initial step).

The chamber 45 is arranged so that an increase in the volume of the chamber 45 (for example by releasing the wall 13) opens the feed valve 4, at least when the chamber 45 is filled (preferably completely) with the product 16 (which is not yet the case in this initial step).

The chamber 45 is separated from an outlet 6 of the device 1 at least by a dispensing valve 5.

The dispensing valve 5 is flexible, typically thermoplastic elastomer (TPE) or a thermoplastic polyurethane elastomer of 80 Shore A.

The chamber 45 is arranged so that a decrease in the volume of the chamber 45 (for example by pressing on the wall 13) opens the dispensing valve 5, at least when the chamber 45 is filled (preferably completely) by the product 16 (which is not yet the case in this initial step).

The chamber 45 is arranged so that an increase in the volume of the chamber 45 (e.g., by releasing the wall 13) closes the dispensing valve 5, at least when the chamber 45 is filled (preferably completely) by the product 16 (which is not yet the case in this initial step).

When open, the feed valve 4 allows a product passage, typically from the reservoir 3 to the chamber 45. When closed, the feed valve 4 does not allow such a product passage.

When opened, the dispensing valve 5 allows passage of product, typically from the chamber 45 to the outlet 6. When closed, the dispensing valve 5 does not allow such a product passage.

A feed orifice connects the chamber 45 to the feed conduit.

The feed valve 4 comprises a membrane which, in the closed state of this feed valve 4, is pressed against the feed orifice so as to close this feed orifice, and in the open state of this feed valve 4, deviates from the feed orifice so as to open this feed orifice; the feed valve 4 is an independent part of the head 2, and is housed (at least its membrane) on the side of the chamber 45.

The feed valve 4 (movable between its closed and open positions) is, in its closed state, kept pressed against a stationary part (called the feeding seat, which at least partially surrounds the periphery of the associated feed orifice), which is also a "rigid" (i.e. no flexible material) part, of an inner wall of the chamber 45. More precisely, the feed valve 4 comprises a membrane which, in the closed state of the feed valve 4, is kept pressed against the feeding seat, and away from this feeding seat in its open state.

The wall 13 is not mechanically connected to the feed valve 4. The feed valve 4 is a single wall that covers the feeding seat, the feed valve 4 does not fit into the feed channel.

The feeding seat is located inside the chamber 45.

A dispensing orifice connects the chamber 45 to the dispensing conduit.

The dispensing valve 5 is an independent part of the head 2 and is housed (entirely) inside the dispensing conduit.

The dispensing valve 5 comprises a membrane which, in the closed state of this dispensing valve 5, is pressed against the dispensing orifice so as to plug this dispensing orifice, and in the open state of this dispensing valve 5, deviates from the dispensing orifice so as to open this dispensing orifice.

The dispensing orifice is located on a side wall of the dispensing conduit, so that the dispensing orifice, the dispensing conduit and the dispensing valve 5 are arranged so that the product travels globally (i.e. to say on a larger scale than the vortices of the microparticles of the product 16) at a right angle or substantially a right angle, passing from the chamber 45 to the dispensing conduit, that is to say, between the direction of propagation of the product at the inlet of the dispensing valve 5 and the direction of propagation of the product at the outlet of the dispensing valve 5.

The dispensing valve 5 (movable between its closed and open positions) is, in its closed state, kept pressed (sufficiently firmly, by means of return means or a return spring of the valve 5 for example as described in the patent WO2015/155318) against an immobile part (called dispensing seat, which surrounds at least partially the periphery of the associated dispensing orifice), which is also a "rigid" (i.e. not flexible material) part, of an inner wall of the dispensing conduit. More precisely, the dispensing valve 5 comprises a diaphragm which, in the closed state of the dispensing valve, is kept pressed against the dispensing seat, and away from this seat in its open state. It is further noted that the dispensing seat is a lateral part of the dispensing conduit, that is to say that this seat is limited to a face, preferably plane, of an internal wall of the dispensing conduit and is not all around a section of the dispensing conduit that would be made in a plane perpendicular to the direction of elongation of the dispensing conduit.

The dispensing seat is located outside the chamber 45.

The feed orifice is located on a side wall of the feed conduit, so that the feed orifice, the feed conduit and the feed valve 4 are arranged so that the product travels globally at a right angle or substantially a right angle, passing from the feed conduit to the chamber 45, that is to say, between the direction of propagation of the product at the inlet of the feed valve 4 and the direction of propagation of the product at the outlet of the feed valve 4.

The feed valve 4 and the distribution valve 5 are connected by a connecting element, this feed valve 4, this dispensing valve 5 and the connecting element being integral and in one piece (manufactured for example a thermoplastic elastomer (TPE) or a thermoplastic polyurethane elastomer). This unique piece is monoblock. The junction element typically has a hardness of 70-80 Shore A. A hole creates a passage between the dispensing conduit and the feed conduit without passing through the chamber 45. The junction element plugs this hole and is maintained by tightening in this hole.

Then, with reference to FIG. 2, the first embodiment of the method according to the invention comprises a step of "putting under evacuation" (also called depression step) in which a depression is created in the deformable chamber 45 with respect to the reference pressure.

This reference pressure is equal to the atmospheric pressure, i.e. equal to 1 bar. This depression corresponds to a pressure difference of at least 0.2 or even 0.3 bar relative to the reference pressure, preferably at least 0.5 bar relative to the reference pressure, preferably from at least 0.7 bar relative to the reference pressure.

It will be noted that, in the present description, any reference to pressure or depression refers to a gas, the composition of which may possibly change during the method according to the invention.

During the evacuation step, the wall 13 is moved so as to increase the volume of the chamber 45 and/or the wall 13 is displaced so as to reduce the volume of the chamber, for example by means of a vibrating jack 25, preferably in at least one (or more) round trip(s), each round trip comprising a displacement of the wall 13 so as to increase the volume of the chamber 45 and a displacement of the wall 13 so as to reduce the volume of the chamber 45.

This opens the valve 4 and the valve 5 and thus ensures the proper realization of the depression or vacuum (which is a partial vacuum) inside the chamber 45 despite the existence of valves 4 and/or 5.

The action of the jack 25 is a useful aid, but is not mandatory especially in the case of a valve 4 and/or a valve 5 very flexible or not very tight with a possible space between the valve 4 or 5 and its seat.

During the evacuation step, the device 1 is in an enclosure 18 in which the evacuation is produced by suction carried by suction means 26 (such as a pump).

The evacuation step creates the depression:

in the reservoir 3.

in a space around (and in contact with) the reservoir 3, in the deformable chamber 45, from the deformable chamber 45 to the outlet 6 of the device 1, that is to say in the dispensing conduit, and from the deformable chamber 45 to the reservoir 3, that is to say in the feed conduit.

The outlet 6 is not plugged during the evacuation step. This can help to get the air out also through the outlet 6.

The walls 31, 32 of the reservoir 3 are kept apart from each other during the evacuation step.

Maintaining the space between the walls 31, 32 of the reservoir 3 during the evacuation comprises maintaining the space between the walls 31, 32 of the reservoir 3 by a filling nozzle 11 inserted in the reservoir 3 through the filling opening 8.

Then, with reference to FIG. 3, the first embodiment of the method according to the invention comprises a filling step in which at least part of the reservoir 3 is filled with the product 16.

Product 16 is a liquid, a cream, a paste, a gel or a mixture thereof.

The walls 31, 32 of the reservoir 3 are kept apart between them during the filling step.

Maintaining, spaced apart, the walls 31, 32 of the reservoir during the filling step comprises:

a maintenance apart from each other of the walls 31, 32 of the reservoir 3 by the filling nozzle 11 inserted into the reservoir 3 through the filling opening 8 and through which the product 16 is discharged during the filling step, and a maintenance spaced apart from each other by the walls 31, 32 of the reservoir 3 by at least two spacers 12 so that the reservoir 3 is situated between the at least two spacers 12. The spacers 12 are, on the outside of the reservoir 3, in contact with the spaced walls 31, 32.

Each spacer 12 is a suction cup.

The outlet 6 is plugged during the filling step.

In the first embodiment of the method according to the invention illustrated, the evacuation step precedes the filling step. This allows:

to get the air out also through the opening 8 during the evacuation step, and not to trap air bubbles between the product 16 and the reservoir 3 during the filling step.

The order of the evacuation and filling steps may be reversed.

The steps of evacuation and filling are combined or succeeded so as to obtain a so-called "intermediate" state of the device 1 in which:

the reservoir 3 is filled (at least in part) with the product 16, and the inside of the deformable chamber 45 does not include the product 16 but includes a gas at an intermediate pressure lower than the reference pressure.

This intermediate pressure is equal to the pressure obtained by the evacuation created during the evacuation step.

This intermediate pressure is less than 0.7 bar, preferably less than 0.5 bar, preferably less than 0.3 bar or even 0.2 bar.

The intermediate pressure is at least 0.2 or even 0.3 bar lower than the reference pressure, preferably at least 0.5 bar with respect to the reference pressure, preferably at least 0.7 bar relative to the reference pressure.

In the intermediate state corresponding to the end of the step illustrated in FIG. 3, the reservoir 3 is filled (at least in part) with the product 16 while:

in the space 15 around the reservoir 3, from the deformable chamber 45 to the outlet 6 of the device 1, i.e. in the dispensing conduit, and optionally, if the product 16 is sufficiently viscous, from the deformable chamber 45 to the reservoir 3, i.e. in the feed duct, there is no product 16 but gas whose pressure is lower than the reference pressure (and preferably equal to the intermediate pressure).

Then, with reference to FIG. 4, the first embodiment of the method according to the invention comprises a closing step in which the filling opening 8 is sealed or closed.

The closing step is implemented while the device 1 is in its intermediate state.

Closing is performed for example by means of a pliers 9 of ultrasonic welding or hot welding.

The outlet 6 is plugged during the closing step.

There is a means (not shown) arranged to bring the edges of the bag (i.e. the edges of the walls 31, 32 delimiting the opening 8) closer together before welding or closing the opening 8, and implements a step of bringing closer together the edges of the bag (i.e. edges of the walls 31, 32 delimiting the opening 8) before welding or closing the opening 8.

Next, with reference to FIG. 5, the first embodiment of the method according to the invention further comprises, after the closing step and the evacuation step and the filling step, a priming step, during which product 16 is fed from the reservoir 3 to the inside of the deformable chamber 45 (at least as far as between the feed valve 4 and an inner wall (more exactly the feeding seat) of the chamber 45), if the product 16 is highly viscous, for example, preferably so as to fill with the product 16 at least 1% or at least 5% of the internal volume of the chamber 45 (that is to say at the level of the seat of the inlet valve 4), if the product 16 is not very viscous, for example, preferably so as to fill with the product 16 at least 30% of the internal volume of the chamber 45, and preferably so as to completely fill the chamber 45 with product 16.

The priming step starts while the inside of the deformable chamber 45 is at a priming pressure (equal to the intermediate pressure) lower than the reference pressure, which greatly helps this priming.

This priming pressure is less than 0.7 bar, preferably less than 0.5 bar, preferably less than 0.3 bar or even 0.2 bar.

The priming pressure is respectively at least 0.2 or even 0.3 bar lower than the reference pressure, preferably at least 0.5 bar with respect to the reference pressure, preferably at least 0.7 bar with relative to the reference pressure.

The priming step is implemented:

by exerting a force on the reservoir 3 from the outside of the reservoir by mechanical means 14, here identical to the means 12, and by increasing the pressure of the gas in the space around the reservoir 3 starting from the priming pressure and at least up to the reference pressure (up to the reference pressure or beyond the reference pressure); this increase is implemented by opening the enclosure 18, in which the device 1 is located, so as to introduce gas 17 (for example air) into the space 15 around the reservoir 3. This has the advantage of to be very simple and very quick to implement.

Outlet 6 is plugged during the priming step. This prevents the entry of air or gas into the device 1 through the outlet 6 when opening the enclosure.

After priming, the device 1 is then in its "final" state, ready to be used by a user.

In the first embodiment of the method according to the invention, the steps of evacuation, filling, closing and priming are performed within the same enclosure 18 for evacuation.

In this first embodiment:

the evacuation step precedes the filling step, the evacuation step precedes the closing step, the filling step precedes the closing step, the closing step precedes the priming step.

In the first embodiment of the method according to the invention, when the outlet 6 is plugged, it is typically plugged by a plug 19 (for example rubber or polymer) which is pressed against the outlet 6. However, in variants:

with reference to FIG. 6, when the outlet 6 is plugged, it may be plugged by a rod 20 (for example stainless steel) which is inserted into the dispensing channel connecting the dispensing valve 5 at the outlet 6; the inserted rod 20 being arranged to lock the valve 5 in its closed position, or with reference to FIG. 7, when the outlet 6 is plugged, it may be plugged by a plug or film or cap 21 (for example a multilayer polyethylene terephthalate (PET)/aluminum/polypropylene (PP)) fixed film (preferably glued) on the outlet 6.

Note that, in the first embodiment of the method according to the invention, the opening 8 is always located higher than the orifice 7 (the height increases with distance from the earth parallel to the earth's gravity field, or increases in the direction opposite to the direction in which the product 16 flows from the nozzle 11 to the reservoir 3 during the filling step)

A second embodiment of the method according to the invention for manufacturing a product dispensing device 1 will now be described with reference to FIGS. 8 to 10.

This second embodiment will only be described for its differences with respect to the first method embodiment of the invention, and all the numerical references already described above will therefore not necessarily be described again.

In this second embodiment, the reservoir 3 is not formed by a flexible bag but by a tube.

In this second embodiment, the outlet 6 is plugged during the evacuation step, the method being compatible with the manufacture of a device 1 carrying a plug 22. It is also plugged during the filling step, the closing step and the priming step.

In this second embodiment, when the outlet 6 is plugged, it is plugged by a removable plug 22, preferably connected to the head 2 by a hinge 23.

The hinge 23 and the plug 22 are ideally in the same material as the frame of the head 2.

In this second embodiment, the walls 31, 32 do not need to be kept apart.

FIG. 8 illustrates the evacuation step of this second embodiment.

The filling step by the nozzle 11 is not illustrated.

Figure 1:
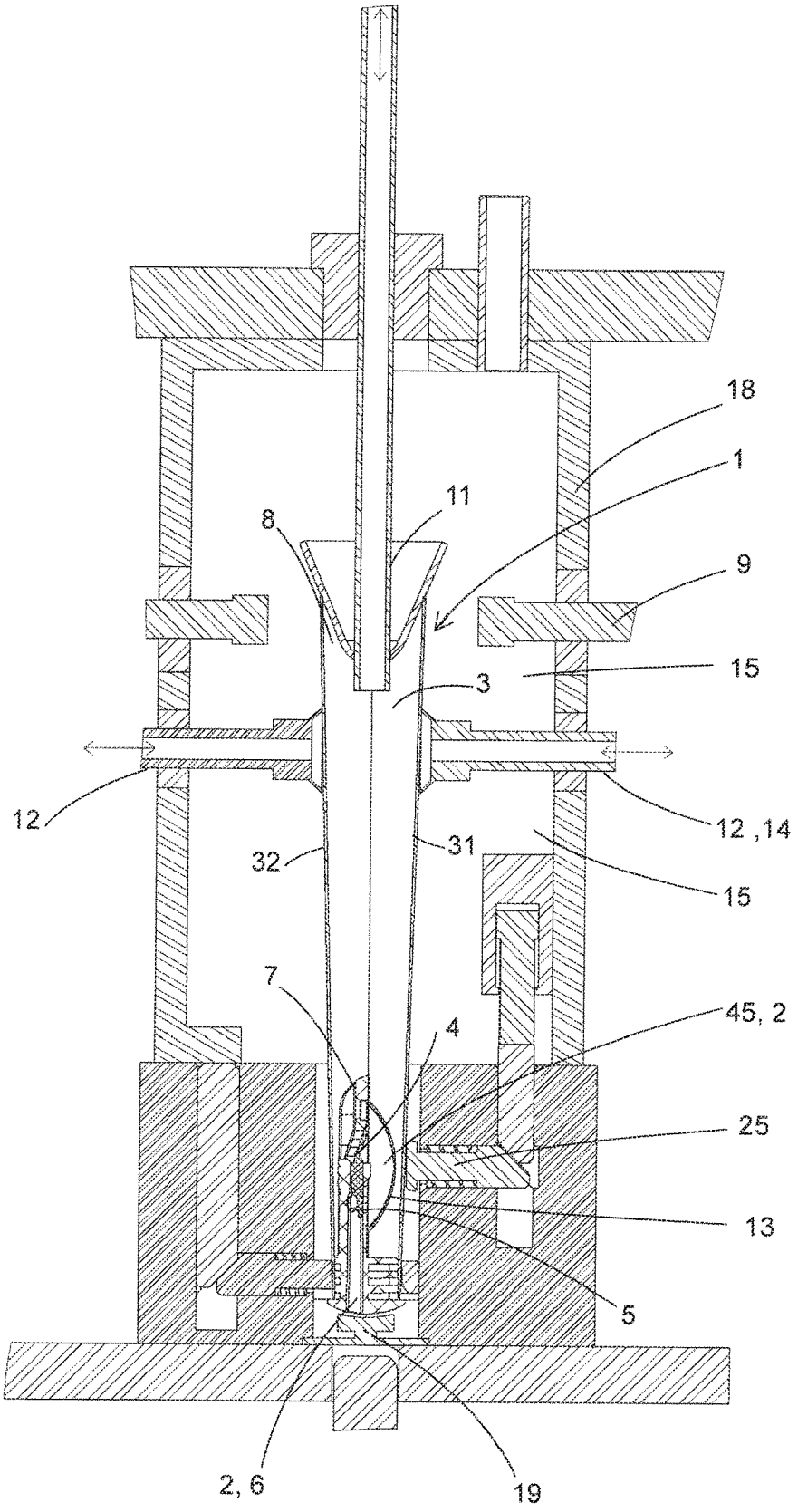
Figure 2:
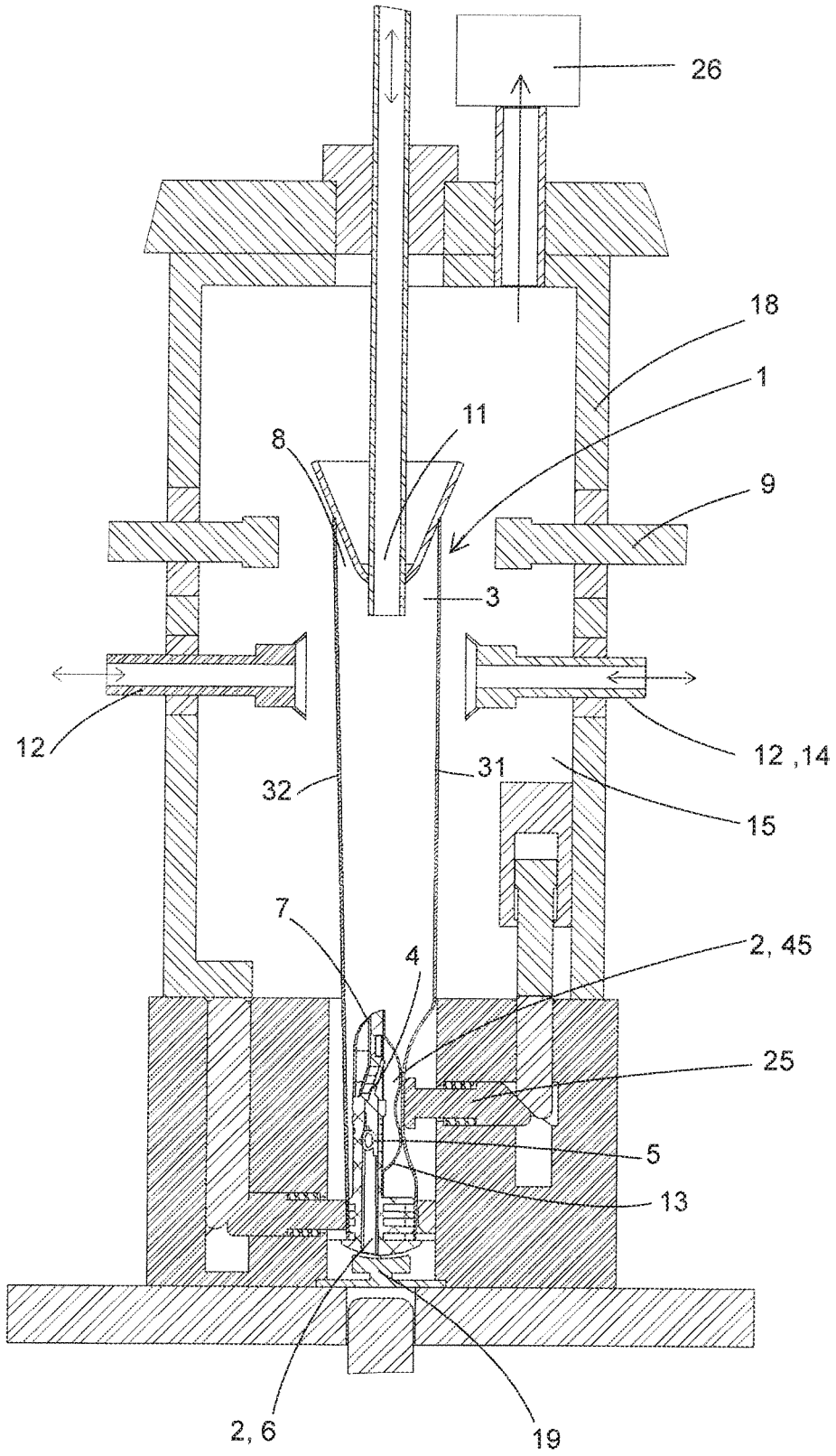
Figure 3:
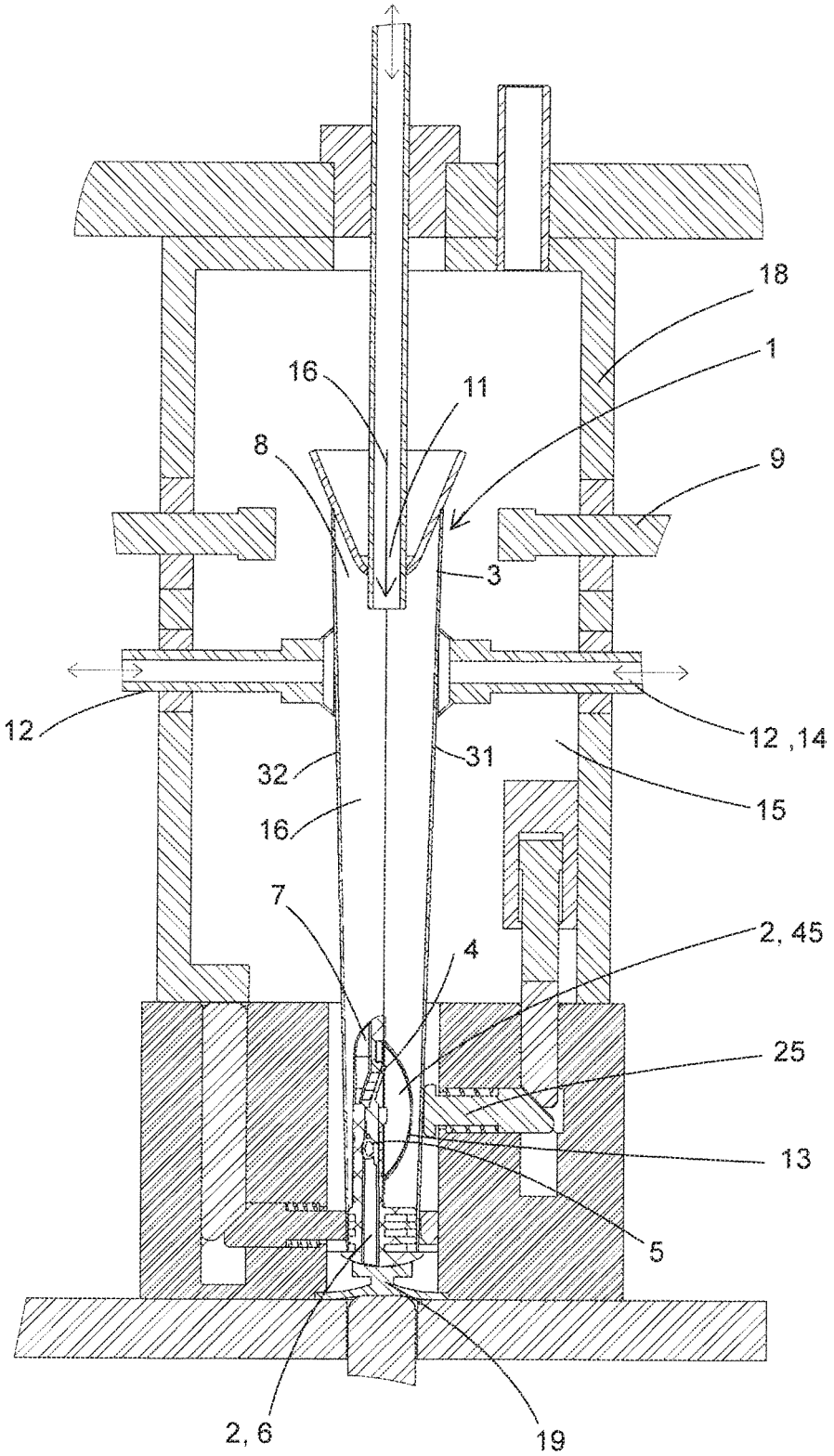
Figure 4:
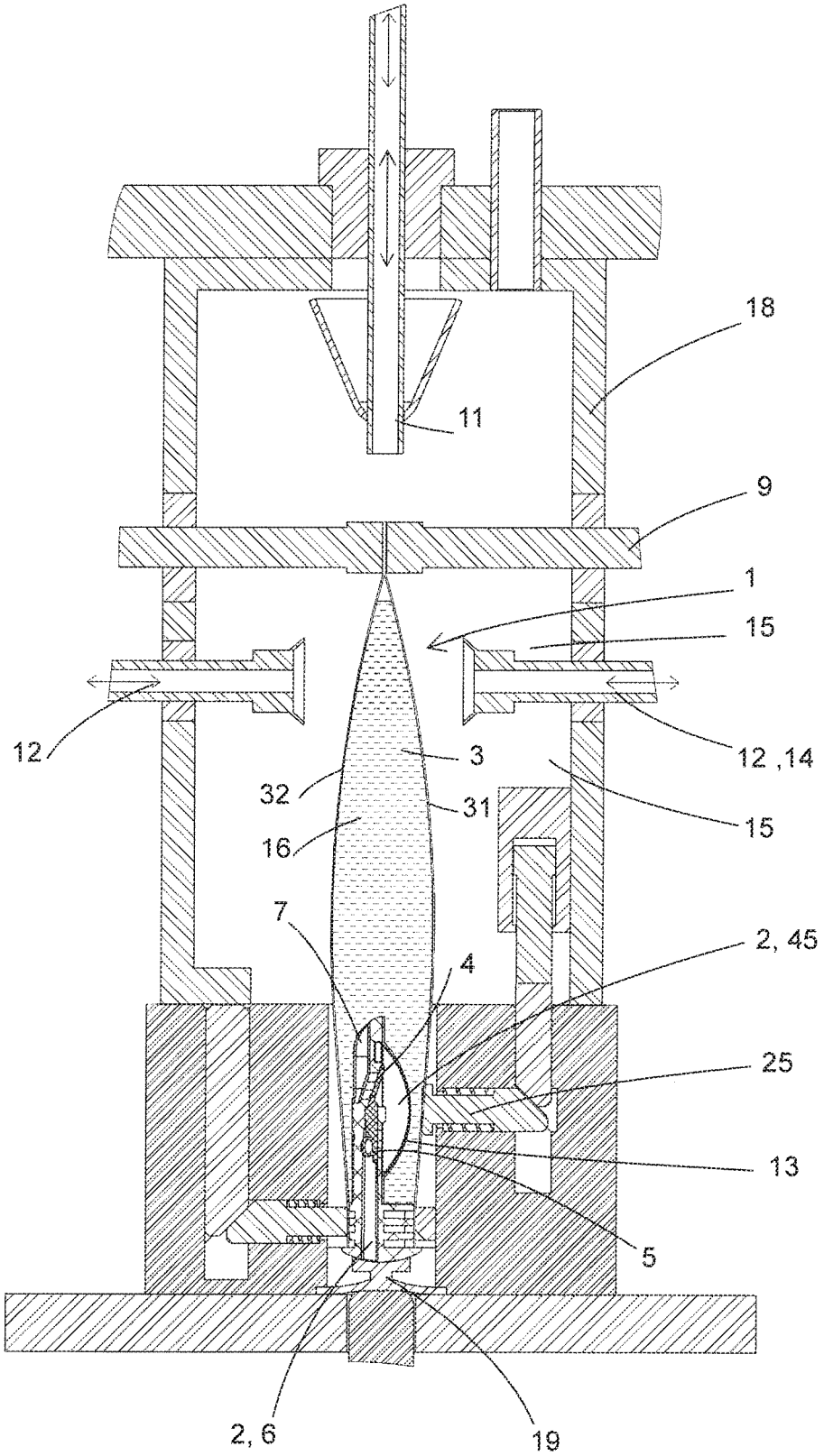
Figure 5:
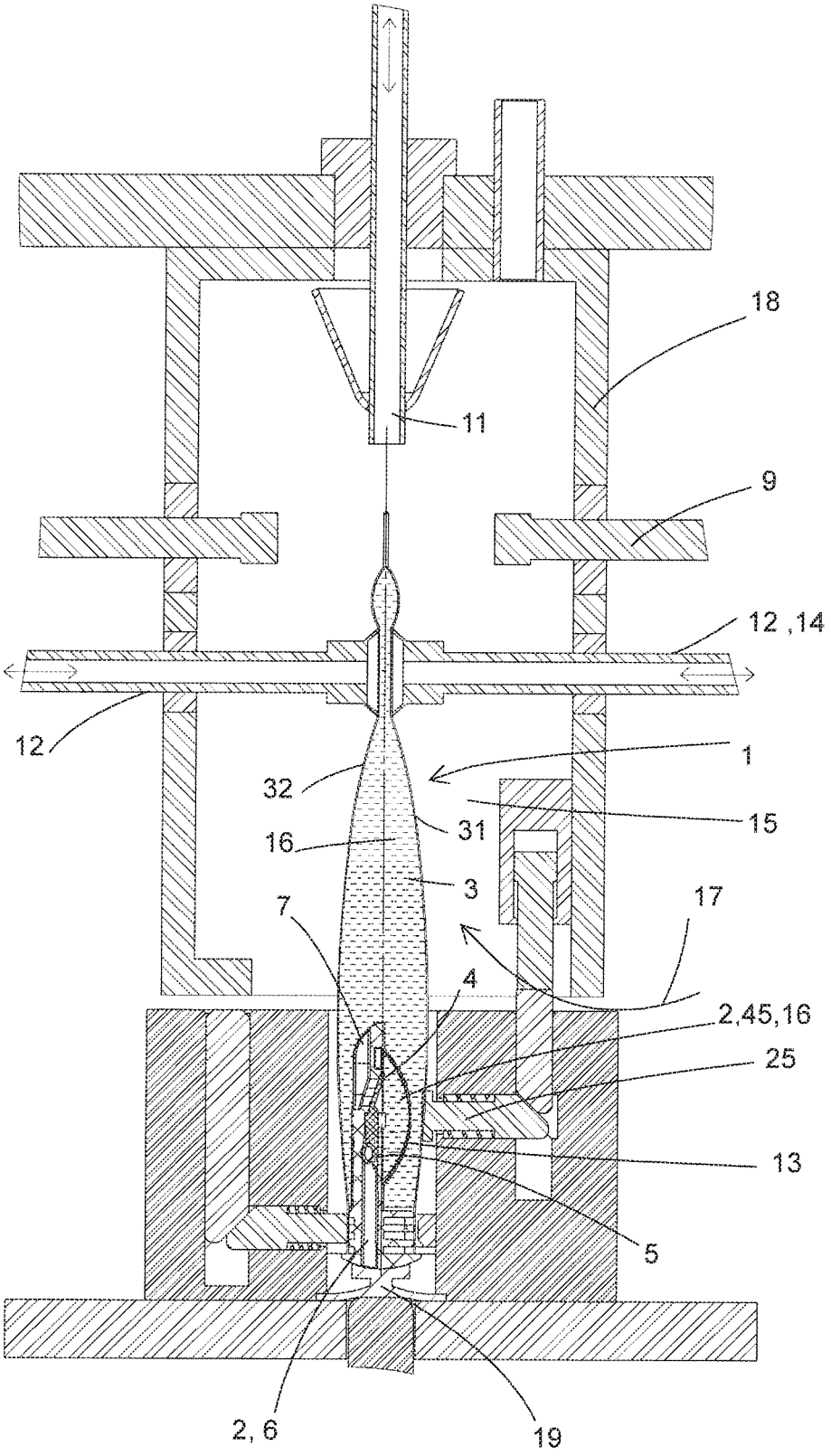
Figure 6:
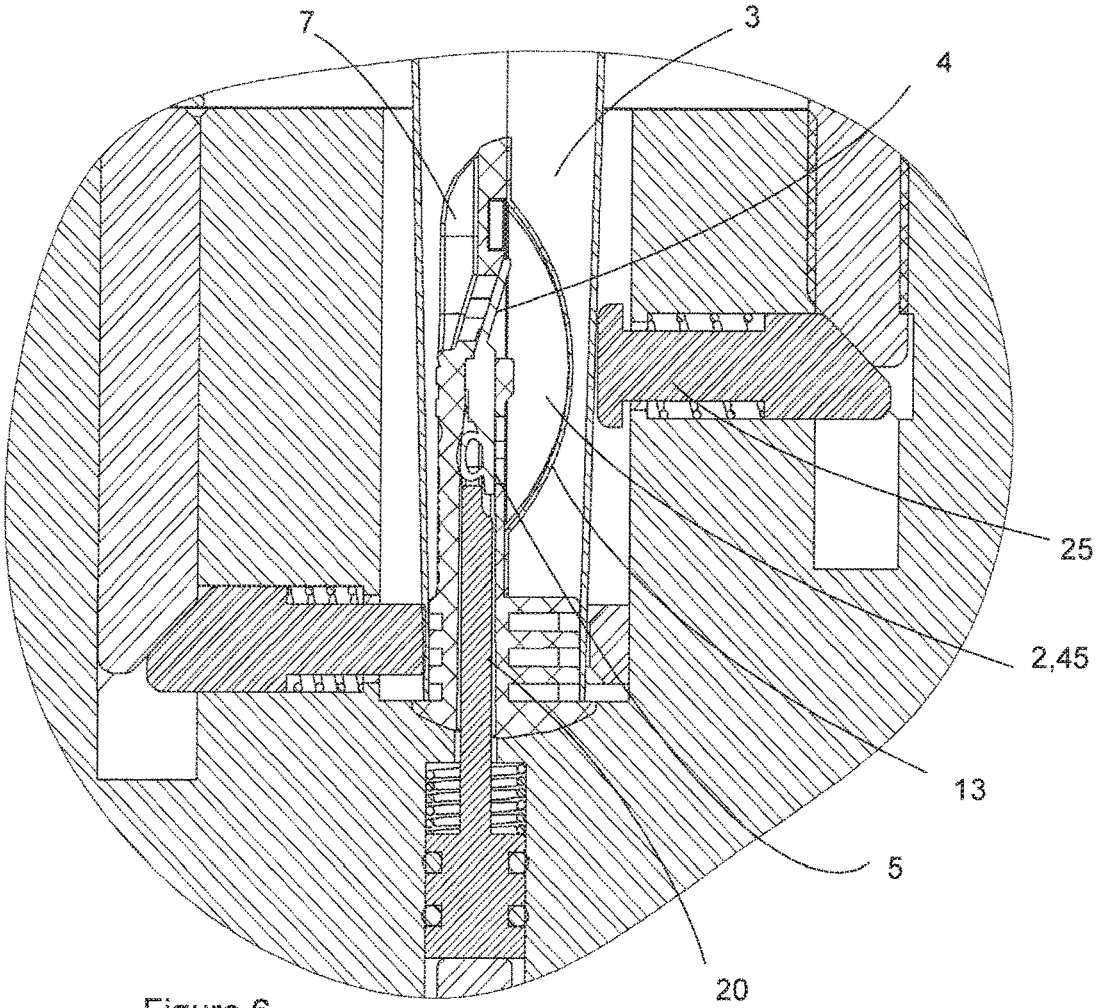
Figure 7:
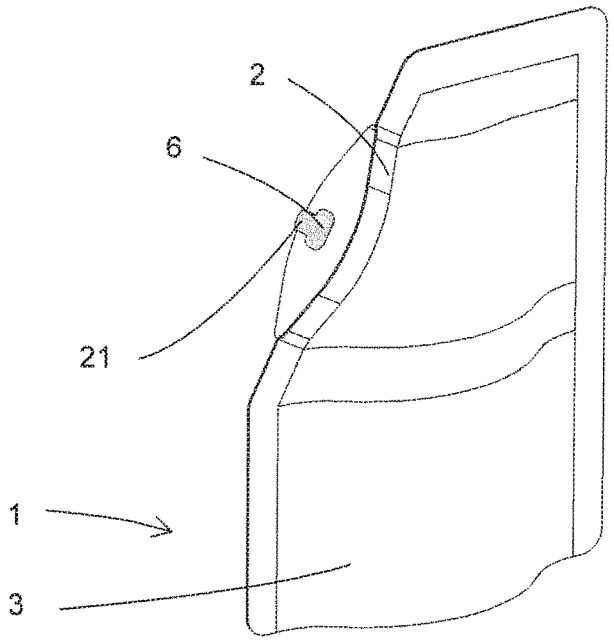
Figure 8:
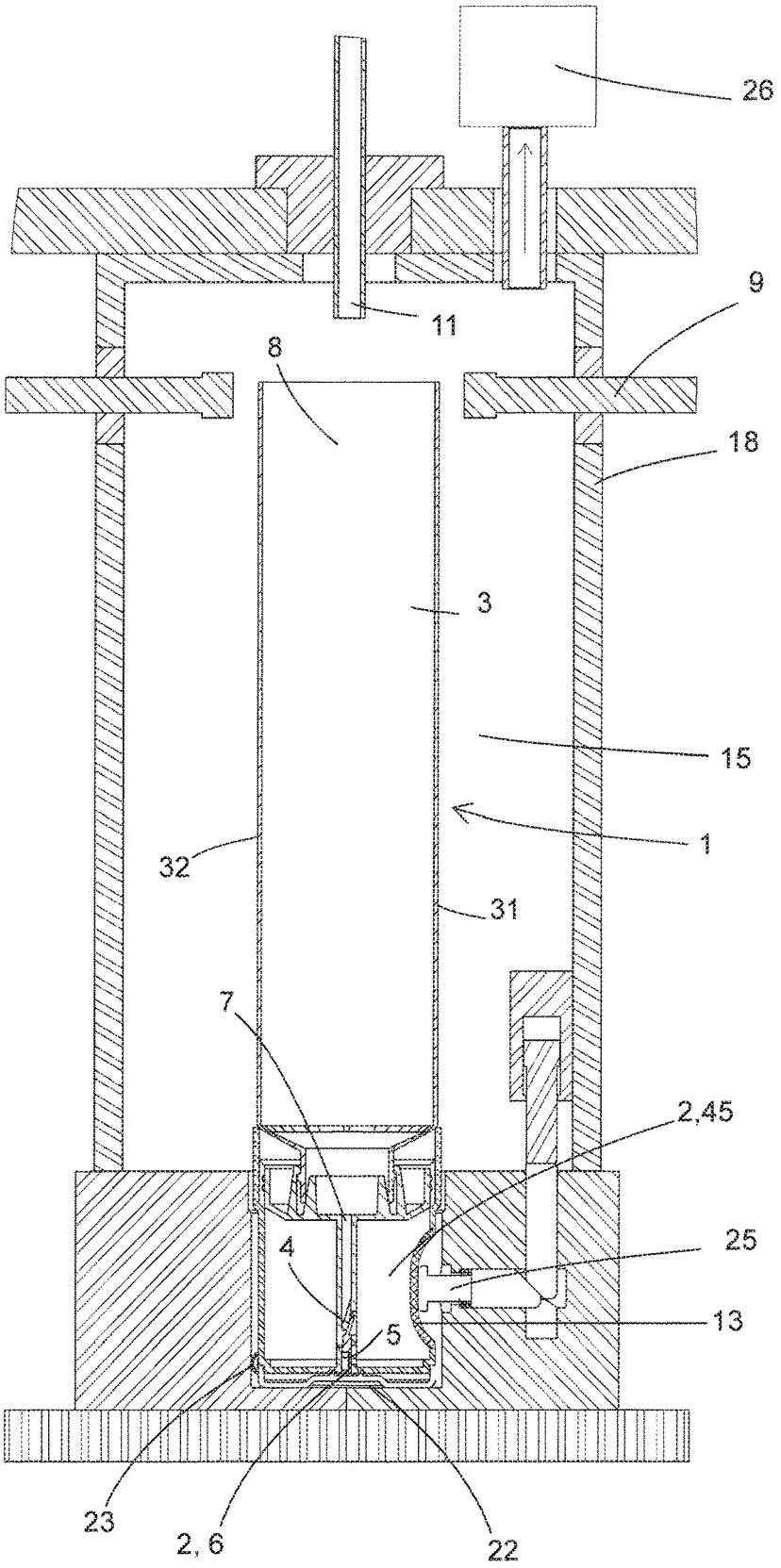
Figure 9:
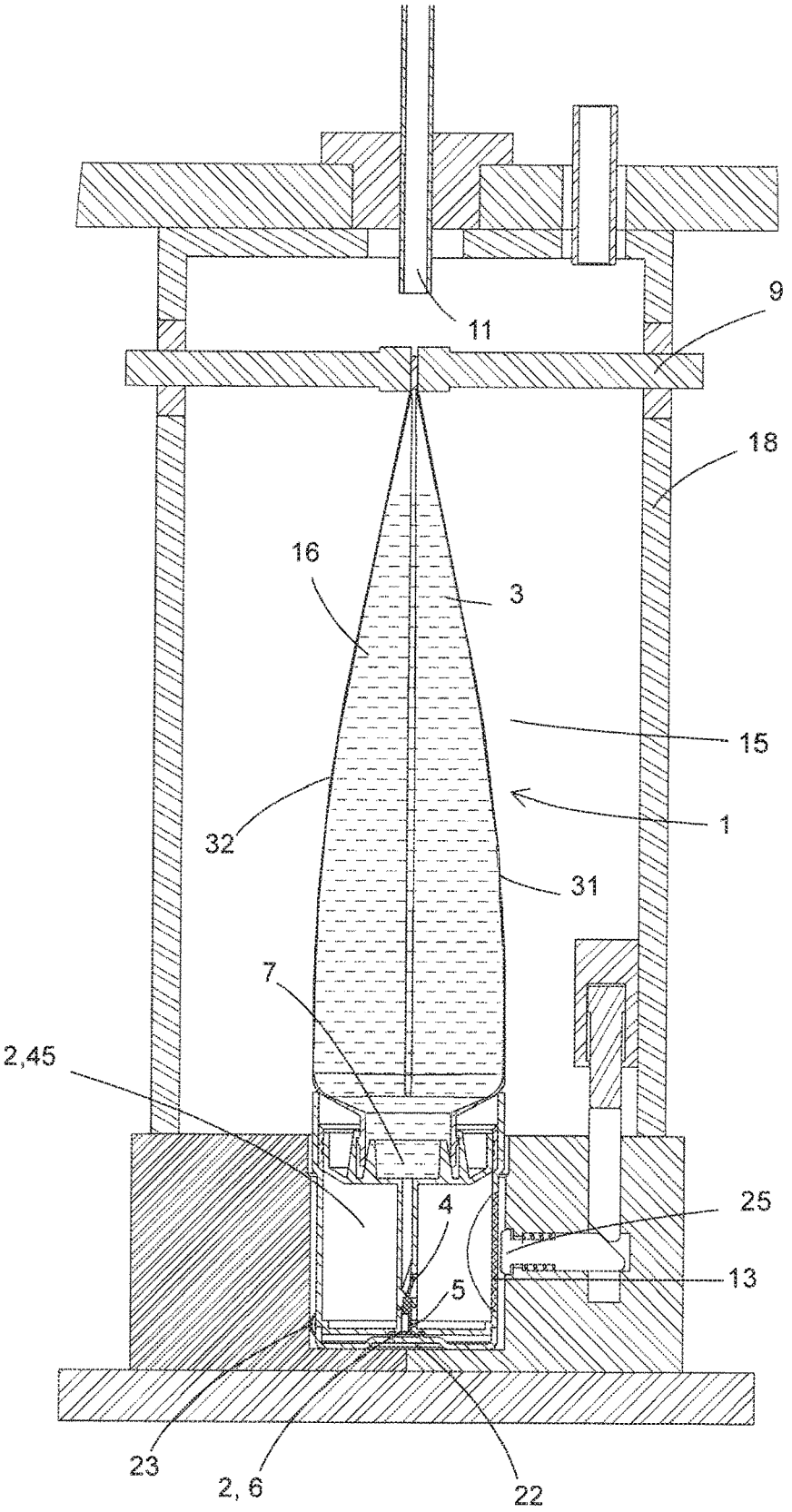
FIG. 9 illustrates the closing step of this second embodiment.
Figure 10:
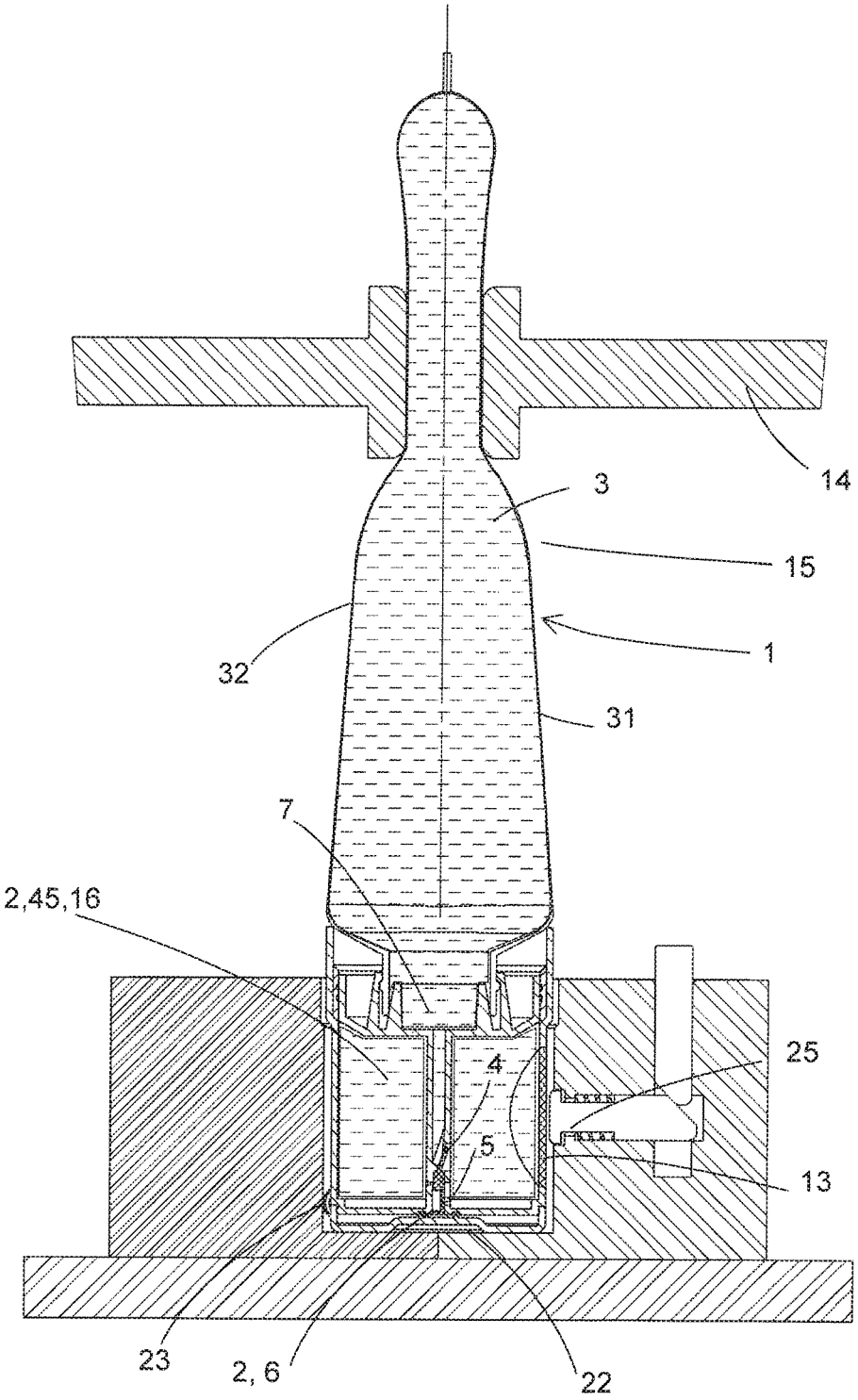
FIG. 10 illustrates the priming step of this second embodiment.
Figure 11:
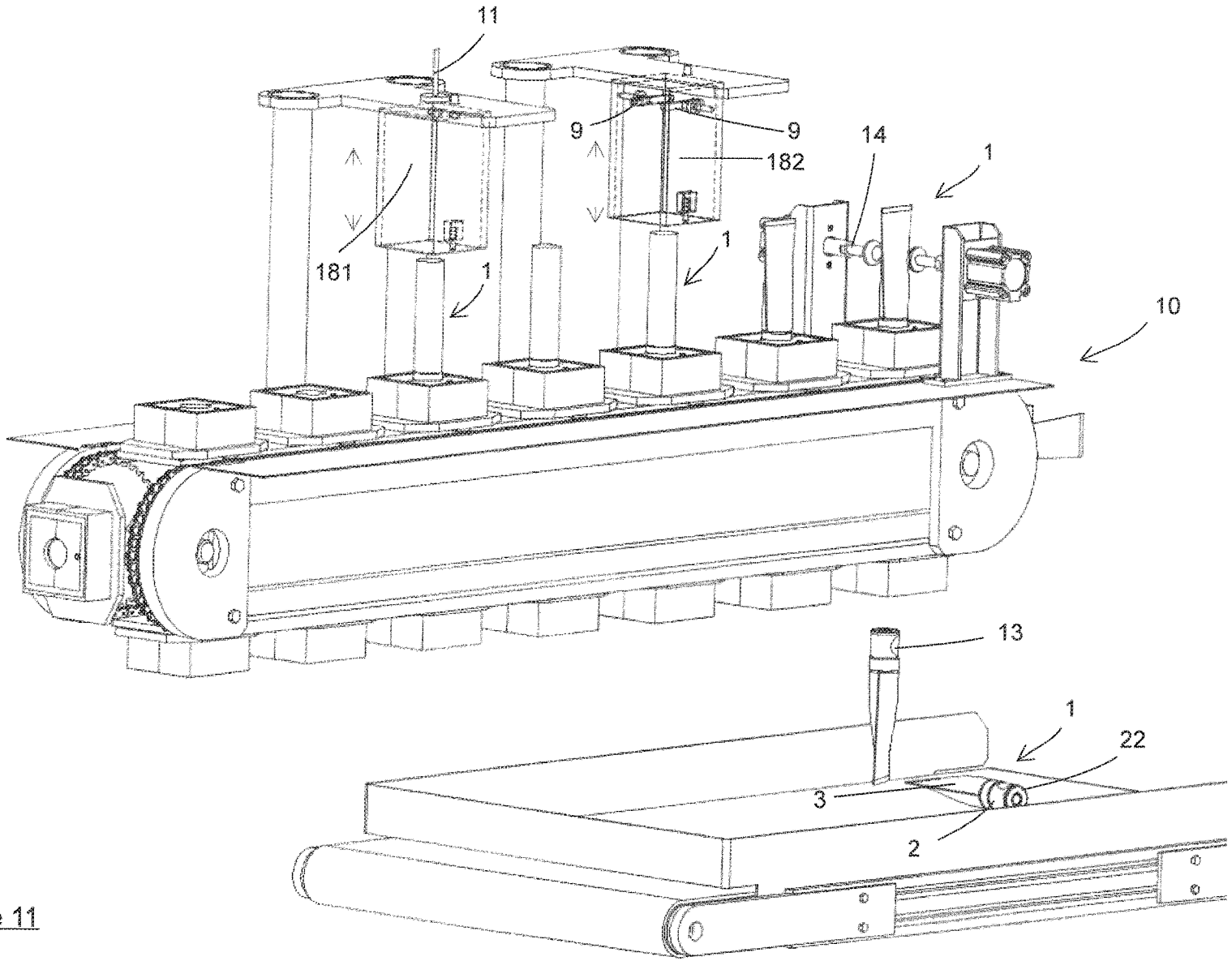

We will now describe, with reference to FIG. 11, variants of each of the two embodiments just described. In these variants, all the steps of the method according to the invention are not necessarily implemented in the same enclosure. In particular the steps:

filling (and possibly evacuation) on the one hand and closing (and possibly priming) on the other hand are made in two separate enclosures 181, 182.

The evacuation step is carried out in a first enclosure 181, so as not to trap an air bubble between the product 16 and the reservoir 3 and to create the depression in the chamber 45, particularly if the product 16 is viscous.

The filling step is then performed in the first enclosures 181.

The device 1 is then transported from the first enclosures 181 to a second enclosures 182 with the outlet 6 plugged by the means 19, 20 or 21, so as to be able to maintain the depression in the chamber 45.

Then, the "evacuation" is made at the priming pressure around the reservoir 3 in the second enclosures 182 in anticipation of priming.

The step of closing the reservoir 3 is then performed by welding in the second enclosures 182.

A first part of the priming step (by increasing the pressure) is then performed during the opening of the enclosures 182 and the gas inlet 17 in the volume 15.

A second part of the priming step is performed outside the enclosures 181, 182 by the mechanical means 14 crushing the reservoir 3.

The separation of the steps of the method according to the invention in different "stations" or different enclosures allows to increase the production rate.

Figure 12:
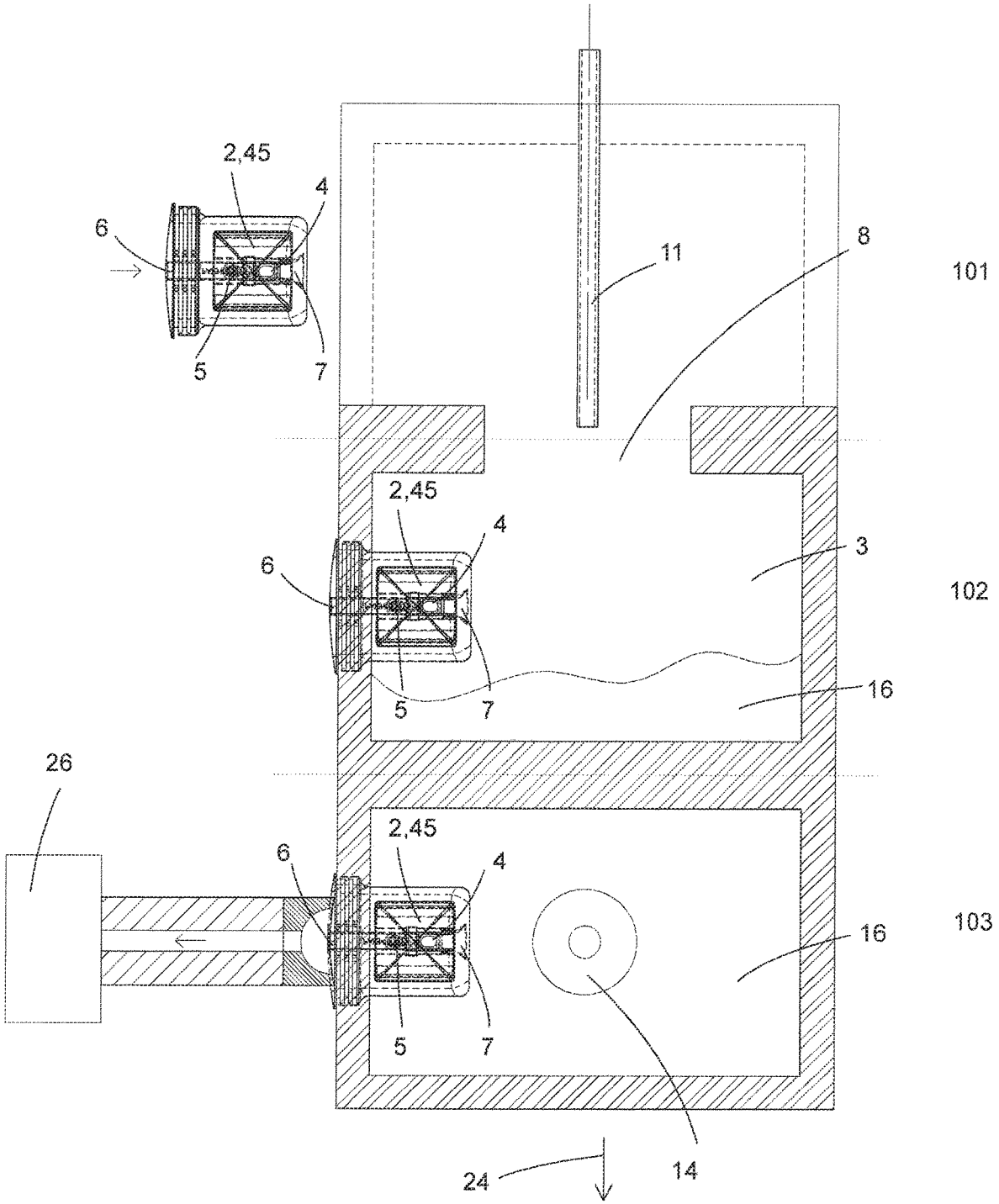

We will now describe, with reference to FIG. 12, a third embodiment of the method according to the invention for manufacturing a device 1, dispenser of product 16.

This third embodiment will only be described for its differences with respect to the first embodiment of the method according to the invention, and all the numerical references already described above will not necessarily be described again.

In this third embodiment:

the filling step precedes the closing step, the closing step precedes the evacuation step, the closing step precedes the priming step, the evacuation step precedes the priming step.

This third embodiment is implemented on a continuous vertical filling machine.

The reservoir 3 is formed by two flexible films which are assembled.

Each of these two films is for example a multilayer polyethylene terephthalate (PET)/aluminum/polypropylene (PP) film.

These two assembled flexible films form several devices 1 connected in series and which move in a direction 24 from one station to another of the filling machine.

The initial step of supplying a device 1 is implemented by assembling these two films between which is inserted the head 2 of this device 1, as illustrated in the part 101 at the top of FIG. 12. The two films are assembled (typically by ultrasonic and/or hot welding technique), leaving the opening 8 open.

Then the device 1 moves in the direction 24 and takes place the step of filling the reservoir 3 of the device 1 by the nozzle 11 with the product 16, as shown in the part 102 at the middle of FIG. 12.

Then the device 1 moves in direction 24 and takes place:

- the step of closing the opening 8 (typically by an ultrasonic welding technique) then
- the evacuation step in which the depression is created in the deformable chamber 45, this depression being created by suction via the outlet 6 (by the means 26), then
- the priming step (typically by the means 14 pressing on the reservoir 3 as previously described), as shown in the part 103 at the bottom of FIG. 12.

Of course, the invention is not limited to the examples which have just been described and many adjustments can be made to these examples without departing from the scope of the invention.

Note that in the embodiments described the filling step precedes the closing step.

Note that in the embodiments described the closing step precedes the priming step.

Note that in the embodiments described the evacuation step precedes the priming step.

Note that, in the embodiments described, the evacuation step may take place:

- before the filling step and/or before the closing step, or
- after the filling step (in the enclosure 18, 181, 182 or elsewhere):
  - between the filling step and the closing step
  - after the closing step (between the closing step and the priming step).

In addition, in the embodiments described, the priming step is not mandatory and this priming can be performed later manually by a user, although this is much less advantageous (in case of leakage, the inside of the chamber 45 can gradually return to atmospheric pressure).

In addition, in a variant of the embodiments described, maintaining the space between the wads 31, 32 of the reservoir 3:

- may be replaced or combined by holding with the spacers 12, during the evacuation step, and/or
- may use only the nozzle 11 or the spacers 12, during the filling step.

In addition, in a variant of the embodiments described, the priming step may be implemented:

- only by exerting a force on the reservoir 3 from the outside of the reservoir by mechanical means 14, or
- only by increasing the pressure of the gas in the space 15 around the reservoir 3 from the priming pressure and up to the reference pressure or beyond the reference pressure.

Furthermore, in a variant of the described embodiments, the deformable mobile wall 13 may be replaced by a movable wall such as a rigid piston connected to an actuating button arranged to move the piston so as to vary the volume of the chamber 45.

In addition, in a variant of the embodiments described, the priming may comprise (preferably at the end of the cycle after the various other steps previously described of the priming) the exertion of a force on the chamber 45, typically on the wall 13. This may for example allow a little more product 16 to enter the chamber 45 to ensure that the device 1 does not become useless later.

A fourth embodiment of the method according to the invention for manufacturing a product dispensing device 1 will now be described with reference to FIGS. 13 to 16.

This fourth embodiment will only be described for its differences with respect to the first method embodiment of the invention, and all the numerical references already described above will therefore not necessarily be described again.

Figure 13:
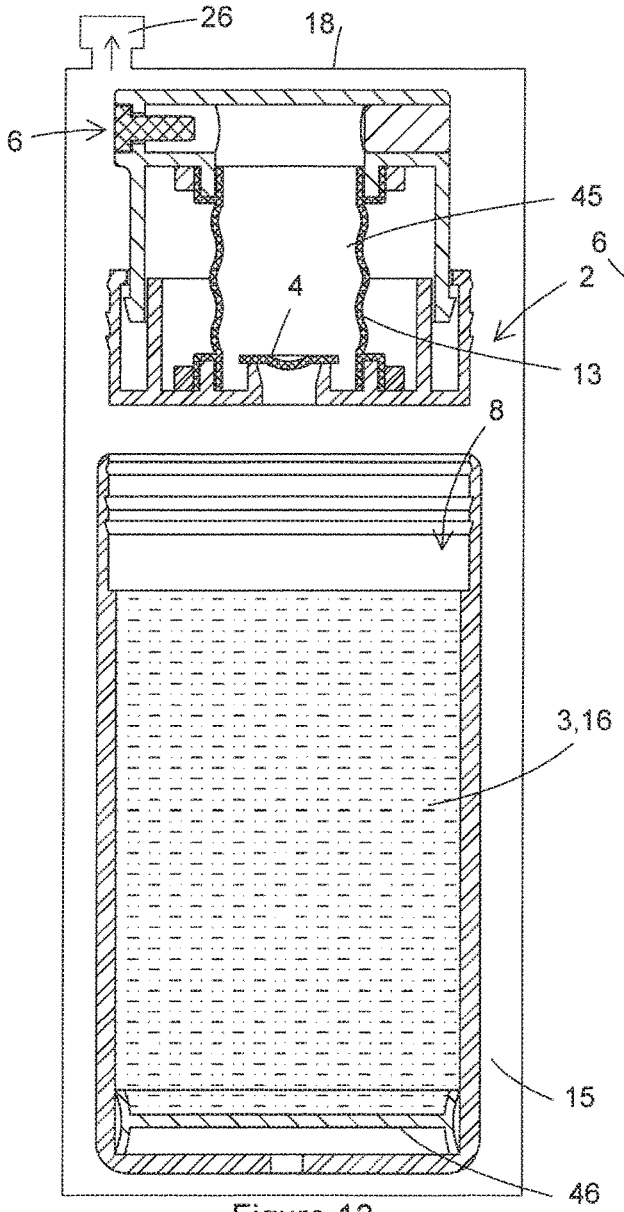

With reference to FIG. 13, in this fourth embodiment, we begin by making:

- the evacuation step in which the depression in the deformable chamber 45 is created with respect to the reference pressure (1 bar), in the enclosures 18 in which the depression is produced by a suction carried out by the suction means 26, and
- the filling step (before, during or after the evacuation step) in which at least part of the reservoir 3 is filled with the product 16.

The evacuation step creates the depression:

- in the space around (and in contact with) the reservoir 3, and
- in the deformable chamber 45.

Figure 14:
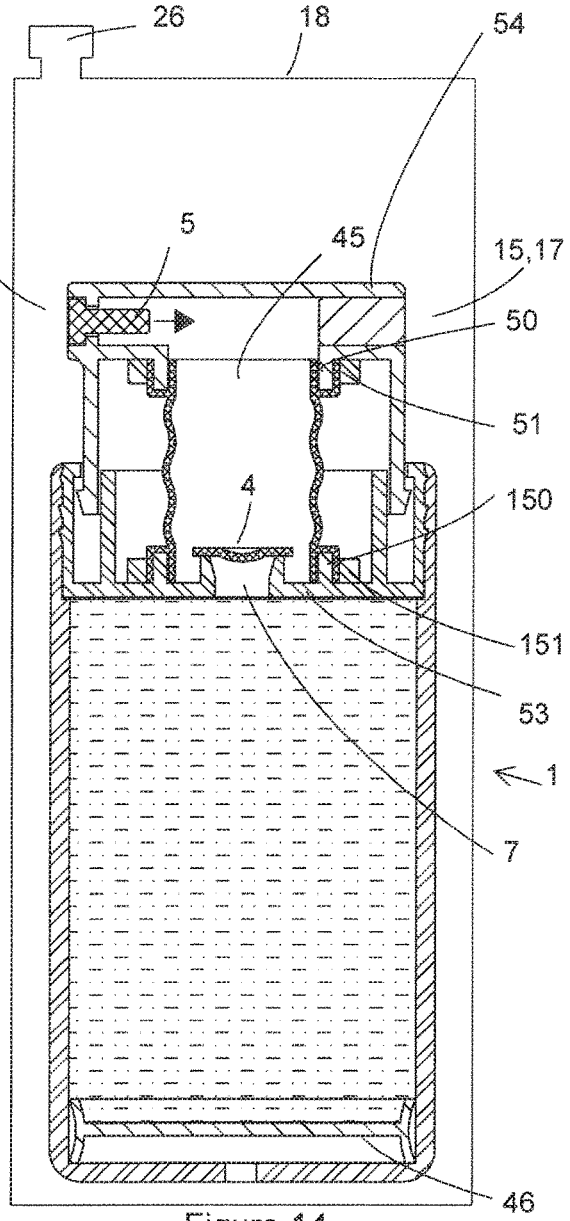

Next, with reference to FIG. 14, this fourth embodiment comprises an assembly of the deformable chamber 45 and the reservoir 3 so as to form the device 1 and implement the step of supplying the device 1. The step of closing is performed during assembly of the deformable chamber 45 and the reservoir 3, more exactly by plugging the opening 8 by the head 2.

After this assembly, the previous steps of evacuation and filling are combined or succeeded so as to obtain a so-called "intermediate" state of the device 1 in which:

- the reservoir 3 is filled (at least in part) with the product 16, and
- the inside of the deformable chamber 45 does not include the product 16 but includes a gas at an intermediate pressure lower than the reference pressure.

Figure 15:
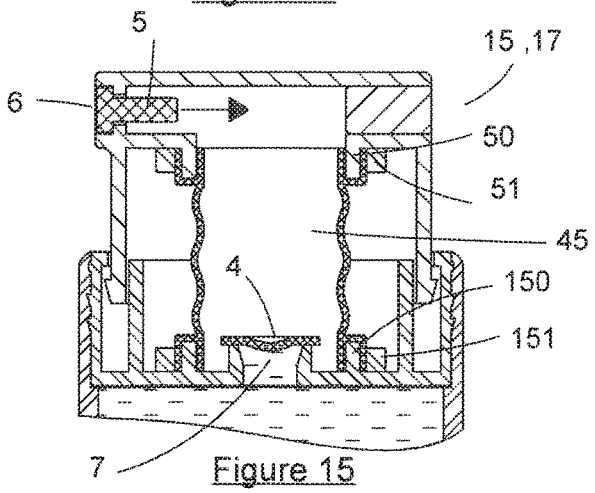
Figure 16:
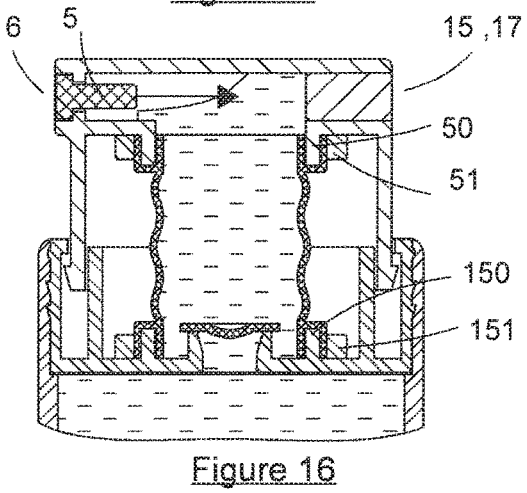

Then, with reference to FIGS. 15 and 16, this fourth embodiment comprises the priming step, during which product 16 is brought from the reservoir 3 to the inside of the deformable chamber 45.

The amount of product that rises depends on the airtightness of the chamber 45 and the level of depression in the chamber 45.

FIG. 15 illustrates the minimum level of product rise in the chamber 45 (product 16 from the reservoir 3 up between the feed valve 4 and an inner wall (more exactly the feeding seat) of the chamber 45)).

FIG. 16 illustrates a high level of product rise in the chamber 45: product 16 from the reservoir 3 to the interior of the deformable chamber 45, preferably so as to fill with product 16 at least 1% or at least 5% of the internal volume of the chamber 45 (that is to say at the level of the seat of the inlet valve 4), preferably so as to fill with product 16 at least 20%, even at least 30% of the volume inside the chamber 45 for example if the dispensing valve 5 is more hermetic and/or if the product 16 is low viscosity, preferably so as to fill 70% or integrally with product 16 the chamber 45 for example if in addition to the depression is high. The level of rise required for priming also depends on the nature of the product, a gel in general requires less rise.

The priming step starts while the inside of the deformable chamber 45 is at the starting pressure (equal to the intermediate pressure) lower than the reference pressure, which greatly helps this priming.

The reservoir 3 is delimited at least in part by a movable wall 46 in contact with the space 15.

The priming step is carried out by increasing the gas pressure in the space around the reservoir 3 from the priming pressure and at least up to the reference pressure (up to reference pressure or above the reference pressure); this increase is implemented by opening the enclosures 18 in which the device 1 is located so as to introduce gas 17 (for example air) into the space 15 around the reservoir 3.

This increase causes aspiration by the chamber 45 and a thrust of the wall 46 so as to reduce the volume of the reservoir 3. This facilitates the priming.

This has the advantage of being very simple and very quick to implement.

The dispensing valve 5 is more firmly sealed than the feed valve 4.

For the same depression (typically at least 0.2 or even 0.3 bar or at least 0.5 bar or at least 0.7 bar or between 0.7 and 0.95 bar, corresponding to the depression in the chamber created during the evacuation step or corresponding to the difference between the reference pressure and the "intermediate pressure" or the difference between the reference pressure and the "priming pressure"):

- in the chamber 45 with respect to the outlet 6 or the space 15 (suction from the chamber 45, preferably during a test in which the dispensing valve 5 is kept, but the feed valve 4 is removed), and thus likely to create a leak through the valve 5 of the outlet 6 to the chamber 45, and
- in the orifice 7 or the feed conduit with respect to the chamber 45 (suction from the orifice 7, preferably during a test in which the feed valve 4 is kept but the dispensing valve 5 is removed), and thus likely to create a leak through the valve 4 of the chamber 45 to the orifice 7,
- the gas leakage (in unit of volume per unit of time) is greater through the feed valve 4 than through the dispensing valve 5, preferably at least twice or even at least 10 times greater, at least for air. Note in passing that this difference in sealing between the valves 4 and 5 is also present in all of the previously described embodiments. The gas leakage through the dispensing valve 5 is preferably even zero.

For the same depression (typically at least 0.2 or even 0.3 bar or at least 0.5 bar or at least 0.7 bar or between 0.7 and 0.95 bar, corresponding to the depression in the chamber created during the evacuation step or corresponding to the difference between the reference pressure and the "intermediate pressure" or the difference between the reference pressure and the "priming pressure"):

- in the chamber 45 with respect to the outlet 6 or to the space 15 (and thus likely to create a leak through the valve 5 of the outlet 6 to the chamber 45) and
- in the chamber 45 with respect to the orifice 7 or the feed conduit (and thus likely to create a leak through the valve 4 of the orifice 7 to the chamber 45),
- the gas leakage (in unit of volume per unit of time) is greater through the feed valve 4 than through the dispensing valve 5, preferably at least twice or even at least 10 times greater, at least for air. Note in passing that this difference in sealing between the valves 4 and 5 is also present in all of the previously described embodiments. The gas leakage through the dispensing valve 5 is preferably even zero.

The leakage rate of the feed valve 4 is greater than 1 $cm^3$/minute (typically for air at 20° C. and the depression in the chamber 45 corresponding to the priming pressure, i.e. say at the start of the priming step).

The leak rate (typically for air at 20° C.) through the wall 13 is zero or almost zero.

The leak rate (typically for air at 20° C.) through the valve 5 is zero or almost zero.

These zero or almost zero leakage rates of the wall 13 and/or of the valve 5 are measured with a pressure difference (in the chamber 45 and the reservoir 3 with respect to the outlet 6 or the space 15) of 0.9 bar for 1 hour having removed the feed valve 4 for measurements, the sum of the chamber 45 and the reservoir 3 having a total volume of one liter.

The outlet 6 is preferably plugged during the priming step, to prevent any air entering through the outlet 6 to the chamber 45.

It is further noted that the chamber 45 is completely sealed, apart from the valves 4 and/or 5 which can open. In other words, the chamber 45 (apart from the valve 4 and/or 5):

- is bounded only by walls impermeable to gas (i.e. any type of gas, preferably at least air), and
- in the case where the chamber 45 is constituted by an assembly of different walls, all the junctions of these different walls
  - are not permeable to gases (i.e. any type of gas, preferably at least air), or
  - have, for the total of all these junctions, a leakage rate of less than 1 $cm^3$/second or even 0.1 $cm^3$/second
- for depression (typically at least 0.2 or even 0.3 bar or at least 0.5 bar or at least 0.7 bar or between 0.7 and 0.95 bar) corresponding to the depression in the chamber created during the evacuation step or corresponding to the difference between the reference pressure and the "intermediate pressure" or the difference between the reference pressure and the "priming pressure").

Each junction is for example maintained by clamping (for example between two clamping rings respectively 50 and 51 or 150 and 151) or by welding (for example by ultrasonic welding or overmoulding or bi-injection).

In the present case, there are only two junctions:

- a junction (annular) "down" between the wall 13 and the bottom wall 53 carrying the feed valve 4 and/or the feeding seat, and
- a junction (annular) "up" between the wall 13 and the cap 54 carrying the dispensing valve 5 and/or the dispensing seat.

This makes it possible to prevent the entry of air or gas into the device 1 via the outlet 6 during the opening of the enclosures 18, and makes it possible to keep the vacuum in the chamber 45 until it is primed.

The final state is shown in FIG. 15 or 16.

Figure 17:
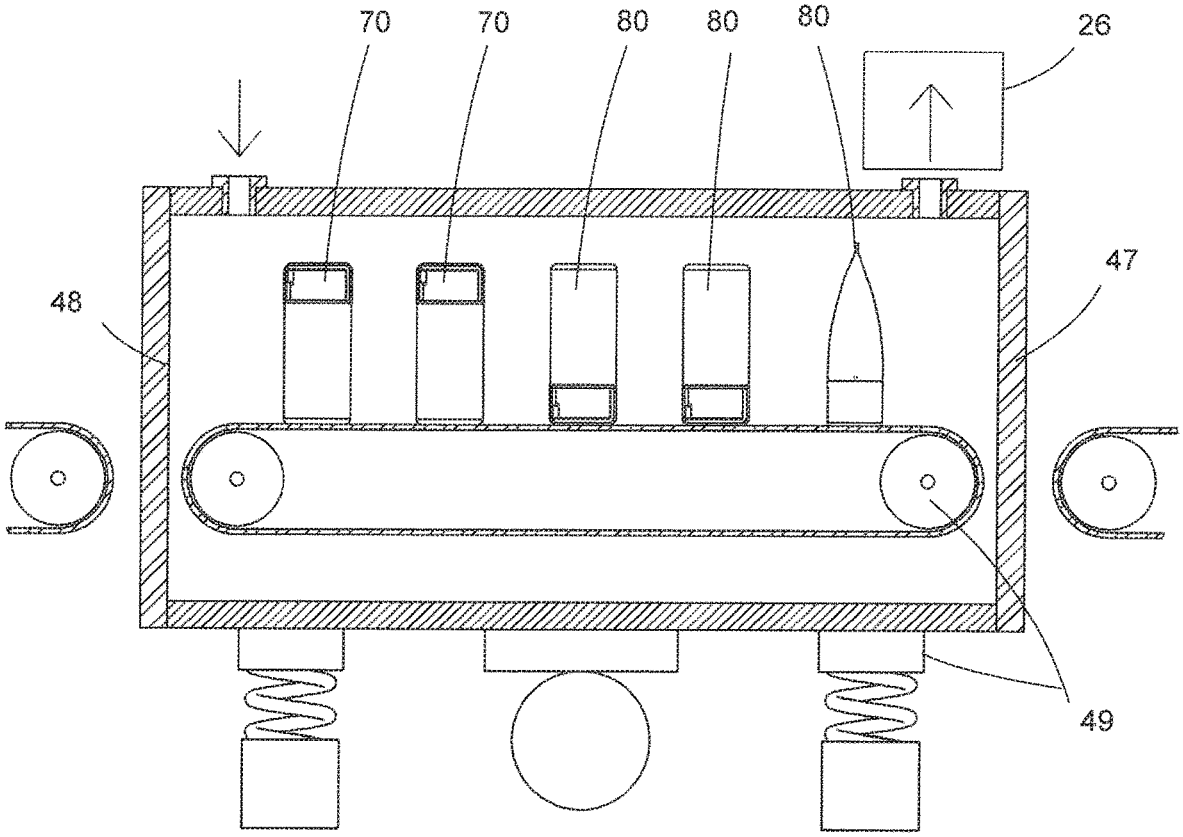
Figure 18:
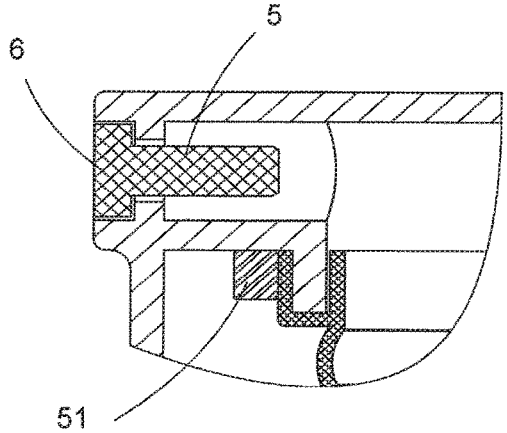
Figure 19:
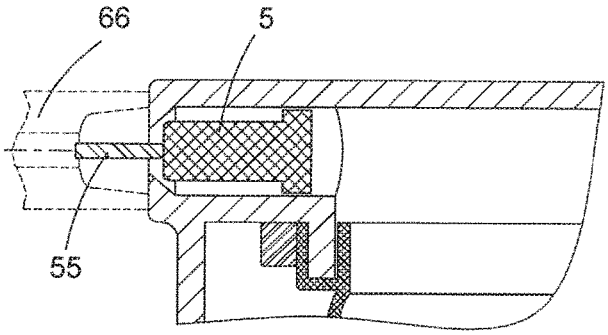

We will now describe, with reference to FIGS. 17 to 19, a variant of the previous embodiments of the method according to the invention, combinable with each of the previously described variants.

In these variants, the enclosure (typically 18) in which the evacuation is carried out is provided with a vibrating support 49 on which the device(s) 1 rest(s).

During the evacuation step, the dispensing valve 5 is opened. Typically, during the evacuation step:

the dispensing valve 5 and/or the feed valve 4 is subjected to vibrations so as to facilitate the creation of the vacuum in the chamber 45 through the valve 4 and/or 5. This makes it possible to facilitate the passage of gas through valve 4 and/or 5, and/or the valve 5 is opened directly by a mechanical action, for example by pressing on it (for example with a tool 55) as illustrated in FIG. 19, preferably if the dispenser 70 according to the invention is placed with head 2 up as illustrated FIG. 17.

During the priming step, or opens the feed valve 4. For example:

the depression is used in the pocket 45, and/or the feed valve 4 is subjected to vibrations. This makes it possible to facilitate the passage of gas through the valve 4. It is preferable that the valve 5 is more firmly sealed than the valve 4.

In these variants, the enclosure (typically 18), in which the evacuation is made, is located along a conveyor and bordered by two removable doors 47 and 48.

If the dispensers 80 according to the invention have the head 2 down in the enclosure (the dispensing valve 5 to the ground) as shown in FIG. 17 the vibrations are not necessary, the depression created in the enclosure will create a depression as much as possible in the chamber 45, the reservoir 3 is flexible, and can be deformed. This depression will suck the air into the pocket 45, at atmospheric pressure, the product near the valve 4 will enter the chamber 45.

With reference to FIG. 19, the priming operation can take place outside the enclosure 18 at atmospheric pressure with a suction head 66 provided with a tool 55, but when the head 66 is withdrawn, the valve 5 must be closed, so the tool 55 no longer acts on the valve 5 during the withdrawal and even a little before the removal of the head 66.

Of course, the various features, shapes, variants and embodiments of the invention can be associated with each other in various combinations to the extent that they are not incompatible or exclusive of each other. In particular all the variants and embodiments described above are combinable with each other.

Note that in all the embodiments of FIGS. 1 to 18, the dispensing valve 5 is arranged to move from its closed position to its open position when:

a stream of fluid is created from the chamber 45 towards the outlet 6 or towards the space 15 (for example by sucking from the space 15), and/or a depression is created in the outlet 6 or in the space 15 with respect to the inside of the chamber 45.

This facilitates the creation of depression in the pocket 45.

The case of FIG. 19 is another opposite variant.

Note that in all the embodiments of FIGS. 1 to 18, the dispensing valve 5 is arranged to remain in its closed position when:

a flow of fluid is created from the outlet 6 or from the space 15 towards the chamber 45, and/or a depression is created in the chamber 45 with respect to the outlet 6 or to the space 15.

This prevents air from entering the chamber 45 through the outlet 6 during priming.

The case of FIG. 19 is another opposite variant.

It will be noted that, in all the embodiments of FIGS. 1 to 19, the feed valve 4 is arranged to move from its closed position to its open position when:

a flow of fluid is created from the orifice 7 or the feed conduit towards the chamber 45, and/or a depression is created in the chamber 45 with respect to the orifice 7 or to the feed conduit.

This facilitates priming.

The invention claimed is:

1. A method for manufacturing a device for dispensing a product, comprising:

an evacuation step in which a depression is created in a deformable chamber with respect to a reference pressure a filling step in which a reservoir is filled with product, a supply of a device comprising the reservoir, said reservoir being connected to the deformable chamber and being provided with a filling opening, the inside of the deformable chamber being delimited at least in part by a movable wall whose displacement causes a variation of the volume of the deformable chamber and:

being separated from the reservoir at least by a feed valve, and/or being separated from an outlet of the device at least by a dispensing valve, then the steps of evacuation, filling and supply being implemented so that, in an intermediate state of the device, the reservoir is filled with product while the inside of the deformable chamber is at an intermediate pressure lower than the reference pressure, and a closing step in which the filling opening is closed; and a priming step during which the product is brought from the reservoir to the inside of the deformable chamber.

2. The method according to claim 1, comprising:

the supply of the device, and then, whatever the order of the following steps:

the evacuation step, the filling step, the closing step.

3. The method according to claim 1, wherein the priming step comprises an increase in the pressure around the reservoir to the reference pressure.

4. The method according to claim 1, wherein the priming step starts while the inside of the deformable chamber is at a priming pressure lower than the reference pressure.

5. The method according to claim 1, wherein the outlet is plugged during the priming step.

6. The method according to claim 1, wherein the feed valve has a leakage rate greater than 1 $cm^3$/minute for air at 20° C.

7. The method according to claim 1, wherein the leakage rate through the movable wall is zero and/or the leakage rate through the dispensing valve is zero.

8. A system for manufacturing a device for dispensing a product, comprising:

evacuation means arranged to create a depression in a deformable chamber with respect to a reference pressure, means for providing a device comprising a reservoir, said reservoir, being connected to the deformable chamber and being provided with a filling opening, the inside of the deformable chamber being delimited at least in part by a movable wall whose displacement causes a variation of the volume of the deformable chamber and:

being separated from the reservoir at least by a feed valve, and/or being separated from an outlet of the device at least by a dispensing valve, then the means of evacuation and supply being arranged so that in an intermediate state of the device the reservoir is filled with product while the inside of the deformable chamber is at an intermediate pressure lower than the reference pressure, and closure means arranged to close the filling opening.

9. The method according to claim 1, wherein the chamber is bounded only by walls impermeable to gas and/or is constituted by an assembly of different wall, all the junctions of these different wall having, for the total of all these junctions, a leakage rate less than 1 $cm^3$/second.

10. The method according to claim 1, wherein movable wall is a deformable mobile wall.

11. The method according to claim 1, wherein at least 20% of the product is filled in the internal volume of the chamber.

12. A method for manufacturing a device for dispensing a product, comprising:

an evacuation step in which a depression is created in a deformable chamber with respect to a reference pressure a filling step in which a reservoir is filled with product, a supply of a device comprising the reservoir, said reservoir being connected to the deformable chamber and being provided with a filling opening, the inside of the deformable chamber being delimited at least in part by a movable wall whose displacement causes a variation of the volume of the deformable chamber and:

being separated from the reservoir at least by a feed valve, and/or being separated from an outlet of the device at least by a dispensing valve, then the steps of evacuation, filling and supply being implemented so that, in an intermediate state of the device, the reservoir is filled with product while the inside of the deformable chamber is at an intermediate pressure lower than the reference pressure, a closing step in which the filling opening is closed; and a priming step during which the product is brought from the reservoir to the inside of the deformable chamber;

wherein a feeding valve covers a feeding seat which at least partially surrounds the periphery of an associated feed orifice.

13. The method according to claim 12, wherein it comprises:

the supply of the device, then, whatever the order of the following steps:

the evacuation step, the filling step, the closing step.

14. The method according to claim 12, wherein at least 20% of the product is filled in the internal volume of the chamber.

15. A method for manufacturing a device for dispensing a product, comprising:

an evacuation step in which a depression is created in a deformable chamber with respect to a reference pressure a filling step in which a reservoir is filled with product, a supply of a device comprising the reservoir, said reservoir being connected to the deformable chamber and being provided with a filling opening, the inside of the deformable chamber being delimited at least in part by a movable wall whose displacement causes a variation of the volume of the deformable chamber and:

being separated from the reservoir at least by a feed valve, and/or being separated from an outlet of the device at least by a dispensing valve, then the steps of evacuation, filling and supply being implemented so that, in an intermediate state of the device, the reservoir is filled with product while the inside of the deformable chamber is at an intermediate pressure lower than the reference pressure, a closing step in which the filling opening is closed; and a priming step during which the product is brought from the reservoir to the inside of the deformable chamber;

wherein the feeding valve and/or the dispensing valve is flexible.

16. The method according to claim 15, wherein it comprises:

the supply of the device, then, whatever the order of the following steps:

the evacuation step, the filling step, the closing step.

17. The method according to claim 15, wherein at least 20% of the product is filled in the internal volume of the chamber.

18. A method for manufacturing a device for dispensing a product, comprising:

an evacuation step in which a depression is created in a deformable chamber with respect to a reference pressure a filling step in which a reservoir is filled with product, a supply of a device comprising the reservoir, said reservoir being connected to the deformable chamber and being provided with a filling opening, the inside of the deformable chamber being delimited at least in part by a movable wall whose displacement causes a variation of the volume of the deformable chamber and:

being separated from the reservoir at least by a feed valve, and/or being separated from an outlet of the device at least by a dispensing valve, then the steps of evacuation, filling and supply being implemented so that, in an intermediate state of the device, the reservoir is filled with product while the inside of the deformable chamber is at an intermediate pressure lower than the reference pressure, and a closing step in which the filling opening is closed; and a priming step during which the product is brought from the reservoir to the inside of the deformable chamber;

the method further comprising:

the evacuation step the filling step, then:

an assembly of the deformable chamber and the reservoir so as to form the device and implement the step of supplying the device;

wherein the closing step is performed during assembly of the deformable chamber and the reservoir.

19. A method for manufacturing a device for dispensing a product, comprising:

an evacuation step in which a depression is created in a deformable chamber with respect to a reference pressure a filling step in which a reservoir is filled with product, a supply of a device comprising the reservoir, said reservoir being connected to the deformable chamber and being provided with a filling opening, the inside of the deformable chamber being delimited at least in part by a movable wall whose displacement causes a variation of the volume of the deformable chamber and:

being separated from the reservoir at least by a feed valve, and/or being separated from an outlet of the device at least by a dispensing valve, then the steps of evacuation, filling and supply being implemented so that, in an intermediate state of the device, the reservoir is filled with product while the inside of the deformable chamber is at an intermediate pressure lower than the reference pressure, and a closing step in which the filling opening is closed; and a priming step during which the product is brought from the reservoir to the inside of the deformable chamber;

wherein the method comprises a passage of gas through the dispensing valve during the evacuation step.

20. The method according to claim 19, wherein the dispensing valve is opened during the evacuation step.

21. The method according to claim 19, wherein the dispenser is placed with head up in the enclosure during the evacuation step.

* * * * *